US007275350B2

(12) United States Patent
Pervan et al.

(10) Patent No.: US 7,275,350 B2
(45) Date of Patent: Oct. 2, 2007

(54) METHOD OF MAKING A FLOORBOARD AND METHOD OF MAKING A FLOOR WITH THE FLOORBOARD

(75) Inventors: Darko Pervan, Viken (SE); Tony Pervan, Stockholm (SE)

(73) Assignee: Valinge Innovation AB, Viken (SE)

( * ) Notice: Subject to any disclaimer, the term of this patent is extended or adjusted under 35 U.S.C. 154(b) by 215 days.

(21) Appl. No.: 11/161,520

(22) Filed: Aug. 6, 2005

(65) Prior Publication Data

US 2006/0075713 A1 Apr. 13, 2006

Related U.S. Application Data

(62) Division of application No. 10/235,940, filed on Sep. 6, 2002, now Pat. No. 7,127,860.

(30) Foreign Application Priority Data

Sep. 20, 2001 (SE) ..... 0103130

(51) Int. Cl.
*E04B 2/08* (2006.01)

(52) U.S. Cl. ..... 52/592.1; 52/581; 52/586.1

(58) Field of Classification Search ..... 52/592.1, 52/581, 586.1, 586.2, 591.3
See application file for complete search history.

(56) References Cited

U.S. PATENT DOCUMENTS

| | | | |
|---|---|---|---|
| 213,740 | A | 4/1879 | Conner |
| 714,987 | A | 12/1902 | Wolfe |
| 753,791 | A | 3/1904 | Fulghum |
| 1,124,228 | A | 1/1915 | Houston |
| 1,194,636 | A | 8/1916 | Joy |
| 1,371,856 | A | 3/1921 | Cade |
| 1,407,679 | A | 2/1922 | Ruthrauff |
| 1,454,250 | A | 5/1923 | Parsons |
| 1,468,288 | A | 9/1923 | Een |
| 1,477,813 | A | 12/1923 | Daniels et al. |
| 1,510,924 | A | 10/1924 | Daniels et al. |
| 1,540,128 | A | 6/1925 | Houston |
| 1,575,821 | A | 3/1926 | Daniels |
| 1,602,256 | A | 10/1926 | Sellin |
| 1,602,267 | A | 10/1926 | Karwisch |

(Continued)

FOREIGN PATENT DOCUMENTS

| | | |
|---|---|---|
| AU | 713628 | 1/1998 |

(Continued)

OTHER PUBLICATIONS

U.S. Appl. No. 11/163,085; Pervan et al.; filed Oct. 4, 2005.

(Continued)

*Primary Examiner*—Carl D. Friedman
*Assistant Examiner*—Basil Katcheves
(74) *Attorney, Agent, or Firm*—Buchanan Ingersoll & Rooney PC

(57) ABSTRACT

Floorboards for installation of floors in herringbone pattern are formed with two opposite sides inverted relative to each other. The invention further comprises methods for producing and making floorings comprising such floorboards, as well as fitting pieces and sets of parts for such floorings.

7 Claims, 12 Drawing Sheets

U.S. PATENT DOCUMENTS

| | | | |
|---|---|---|---|
| 1,615,096 | A | 1/1927 | Meyers |
| 1,622,103 | A | 3/1927 | Fulton |
| 1,622,104 | A | 3/1927 | Fulton |
| 1,637,634 | A | 8/1927 | Carter |
| 1,644,710 | A | 10/1927 | Crooks |
| 1,660,480 | A | 2/1928 | Daniels |
| 1,714,738 | A | 5/1929 | Smith |
| 1,718,702 | A | 6/1929 | Pfiester |
| 1,734,826 | A | 11/1929 | Pick |
| 1,764,331 | A | 6/1930 | Moratz |
| 1,778,069 | A | 10/1930 | Fetz |
| 1,787,027 | A | 12/1930 | Wasleff |
| 1,790,178 | A | 1/1931 | Sutherland, Jr. |
| 1,823,039 | A | 9/1931 | Gruner |
| 1,859,667 | A | 5/1932 | Gruner |
| 1,898,364 | A | 2/1933 | Gynn |
| 1,906,411 | A | 5/1933 | Potvin |
| 1,929,871 | A | 10/1933 | Jones |
| 1,940,377 | A | 12/1933 | Storm |
| 1,953,306 | A | 4/1934 | Moratz |
| 1,986,739 | A | 1/1935 | Mitte |
| 1,988,201 | A | 1/1935 | Hall |
| 2,044,216 | A | 6/1936 | Klages |
| 2,266,464 | A | 12/1941 | Kraft |
| 2,276,071 | A | 3/1942 | Scull |
| 2,324,628 | A | 7/1943 | Kähr |
| 2,398,632 | A | 4/1946 | Frost et al. |
| 2,430,200 | A | 11/1947 | Wilson |
| 2,495,862 | A | 1/1950 | Osborn |
| 2,740,167 | A | 4/1956 | Rowley |
| 2,780,253 | A | 2/1957 | Joa |
| 2,851,740 | A | 9/1958 | Baker |
| 2,894,292 | A | 7/1959 | Gramelspacher |
| 2,947,040 | A | 8/1960 | Schultz |
| 3,045,294 | A | 7/1962 | Livezey, Jr. |
| 3,100,556 | A | 8/1963 | De Ridder |
| 3,125,138 | A | 3/1964 | Bolenbach |
| 3,182,769 | A | 5/1965 | De Ridder |
| 3,200,553 | A | 8/1965 | Frashour et al. |
| 3,203,149 | A | 8/1965 | Soddy |
| 3,267,630 | A | 8/1966 | Omholt |
| 3,282,010 | A | 11/1966 | King, Jr. |
| 3,301,147 | A | 1/1967 | Clayton et al. |
| 3,310,919 | A | 3/1967 | Bue et al. |
| 3,347,048 | A | 10/1967 | Brown et al. |
| 3,387,422 | A | 6/1968 | Wanzer |
| 3,460,304 | A | 8/1969 | Braeuninger et al. |
| 3,481,810 | A | 12/1969 | Waite |
| 3,526,420 | A | 9/1970 | Brancalcone |
| 3,538,665 | A | 11/1970 | Gohner |
| 3,548,559 | A | 12/1970 | Levine |
| 3,553,919 | A | 1/1971 | Omholt |
| 3,555,762 | A | 1/1971 | Costanzo, Jr. |
| 3,694,983 | A | 10/1972 | Couquet |
| 3,714,747 | A | 2/1973 | Curran |
| 3,731,445 | A | 5/1973 | Hoffmann et al. |
| 3,759,007 | A | 9/1973 | Thiele |
| 3,768,846 | A | 10/1973 | Hensley et al. |
| 3,786,608 | A | 1/1974 | Boettcher |
| 3,859,000 | A | 1/1975 | Webster |
| 3,902,293 | A | 9/1975 | Witt et al. |
| 3,908,053 | A | 9/1975 | Hettich |
| 3,936,551 | A | 2/1976 | Elmendorf et al. |
| 3,988,187 | A | 10/1976 | Witt et al. |
| 4,037,377 | A | 7/1977 | Howell et al. |
| 4,084,996 | A | 4/1978 | Wheeler |
| 4,090,338 | A | 5/1978 | Bourgade |
| 4,099,358 | A | 7/1978 | Compaan |
| 4,100,710 | A | 7/1978 | Kowallik |
| 4,169,688 | A | 10/1979 | Toshio |
| 4,242,390 | A | 12/1980 | Nemeth |
| 4,299,070 | A | 11/1981 | Oltmanns et al. |
| 4,304,083 | A | 12/1981 | Anderson |
| 4,426,820 | A | 1/1984 | Terbrack et al. |
| 4,471,012 | A | 9/1984 | Maxwell |
| 4,489,115 | A | 12/1984 | Layman et al. |
| 4,501,102 | A | 2/1985 | Knowles |
| 4,561,233 | A | 12/1985 | Harter et al. |
| 4,567,706 | A | 2/1986 | Wendt |
| 4,612,074 | A | 9/1986 | Smith et al. |
| 4,612,745 | A | 9/1986 | Hovde |
| 4,641,469 | A | 2/1987 | Wood |
| 4,643,237 | A | 2/1987 | Rosa |
| 4,646,494 | A | 3/1987 | Saarinen et al. |
| 4,653,242 | A | 3/1987 | Ezard |
| 4,703,597 | A | 11/1987 | Eggemar |
| 4,715,162 | A | 12/1987 | Brightwell |
| 4,738,071 | A | 4/1988 | Ezard |
| 4,769,963 | A | 9/1988 | Meyerson |
| 4,819,932 | A | 4/1989 | Trotter, Jr. |
| 4,831,806 | A | 5/1989 | Niese et al. |
| 4,845,907 | A | 7/1989 | Meek |
| 4,905,442 | A | 3/1990 | Daniels |
| 5,029,425 | A | 7/1991 | Bogataj |
| 5,113,632 | A | 5/1992 | Hanson |
| 5,117,603 | A | 6/1992 | Weintraub |
| 5,148,850 | A | 9/1992 | Urbanick |
| 5,165,816 | A | 11/1992 | Parasin |
| 5,179,812 | A | 1/1993 | Hill |
| 5,216,861 | A | 6/1993 | Meyerson |
| 5,253,464 | A | 10/1993 | Nilsen |
| 5,271,564 | A | 12/1993 | Smith |
| 5,295,341 | A | 3/1994 | Kajiwara |
| 5,349,796 | A | 9/1994 | Meyerson |
| 5,390,457 | A | 2/1995 | Sjölander |
| 5,433,806 | A | 7/1995 | Pasquali et al. |
| 5,474,831 | A | 12/1995 | Nystrom |
| 5,497,589 | A | 3/1996 | Porter |
| 5,502,939 | A | 4/1996 | Zadok et al. |
| 5,540,025 | A | 7/1996 | Takehara et al. |
| 5,560,569 | A | 10/1996 | Schmidt |
| 5,567,497 | A | 10/1996 | Zegler et al. |
| 5,570,554 | A | 11/1996 | Searer |
| 5,597,024 | A | 1/1997 | Bolyard et al. |
| 5,618,602 | A | 4/1997 | Nelson |
| 5,630,304 | A | 5/1997 | Austin |
| 5,653,099 | A | 8/1997 | MacKenzie |
| 5,671,575 | A | 9/1997 | Wu |
| 5,695,875 | A | 12/1997 | Larsson et al. |
| 5,706,621 | A | 1/1998 | Pervan |
| 5,755,068 | A | 5/1998 | Ormiston |
| 5,768,850 | A | 6/1998 | Chen |
| 5,797,237 | A | 8/1998 | Finkell, Jr. |
| 5,823,240 | A | 10/1998 | Bolyard et al. |
| 5,827,592 | A | 10/1998 | Van Gulik et al. |
| 5,860,267 | A | 1/1999 | Pervan |
| 5,899,038 | A | 5/1999 | Stroppiana |
| 5,900,099 | A | 5/1999 | Sweet et al. |
| 5,935,668 | A | 8/1999 | Smith |
| 5,943,239 | A | 8/1999 | Shamblin et al. |
| 5,968,625 | A | 10/1999 | Hudson |
| 5,987,839 | A | 11/1999 | Hamar et al. |
| 6,006,486 | A | 12/1999 | Moriau et al. |
| 6,023,907 | A | 2/2000 | Pervan |
| 6,029,416 | A | 2/2000 | Andersson |
| 6,094,882 | A | 8/2000 | Pervan |
| 6,101,778 | A | 8/2000 | Martensson |
| 6,119,423 | A | 9/2000 | Costantino |
| 6,134,854 | A | 10/2000 | Stanchfield |
| 6,148,884 | A | 11/2000 | Bolyard et al. |
| 6,173,548 | B1 | 1/2001 | Hamar et al. |
| 6,182,410 | B1 | 2/2001 | Pervan |
| 6,203,653 | B1 | 3/2001 | Seidner |
| 6,205,639 | B1 | 3/2001 | Pervan |

| | | | |
|---|---|---|---|
| 6,209,278 | B1 | 4/2001 | Tychsen |
| 6,216,403 | B1 | 4/2001 | Belbeoc'h |
| 6,216,409 | B1 | 4/2001 | Roy et al. |
| 6,247,285 | B1 | 6/2001 | Mobeus |
| 6,314,701 | B1 | 11/2001 | Meyerson |
| 6,324,803 | B1 | 12/2001 | Pervan |
| 6,332,733 | B1 | 12/2001 | Hamberger et al. |
| 6,339,908 | B1 | 1/2002 | Chuang |
| 6,345,481 | B1 | 2/2002 | Nelson |
| 6,363,677 | B1 | 4/2002 | Chen et al. |
| 6,385,936 | B1 | 5/2002 | Schneider |
| 6,397,547 | B1 | 6/2002 | Martensson |
| 6,421,970 | B1 | 7/2002 | Martensson et al. |
| 6,438,919 | B1 | 8/2002 | Knauseder |
| 6,446,405 | B1 | 9/2002 | Pervan |
| 6,490,836 | B1 | 12/2002 | Moriau et al. |
| 6,505,452 | B1 | 1/2003 | Hannig et al. |
| 6,510,665 | B2 | 1/2003 | Pervan |
| 6,516,579 | B1 | 2/2003 | Pervan |
| 6,526,719 | B2 | 3/2003 | Pletzer et al. |
| 6,532,709 | B2 | 3/2003 | Pervan |
| 6,536,178 | B1 | 3/2003 | Palsson |
| 6,584,747 | B2 | 7/2003 | Kettler et al. |
| 6,601,359 | B2 | 8/2003 | Olofsson |
| 6,606,834 | B2 | 8/2003 | Martensson et al. |
| 6,647,690 | B1 | 11/2003 | Martensson |
| 6,672,030 | B2 | 1/2004 | Schulte |
| 6,684,592 | B2 | 2/2004 | Martin |
| 6,715,253 | B2 | 4/2004 | Pervan |
| 6,722,809 | B2 | 4/2004 | Hamberger et al. |
| 6,769,218 | B2 | 8/2004 | Pervan |
| 6,786,019 | B2 | 9/2004 | Thiers |
| 6,851,241 | B2 | 2/2005 | Pervan |
| 6,874,292 | B2 | 4/2005 | Moriau et al. |
| 2001/0029720 | A1 | 10/2001 | Pervan |
| 2002/0014047 | A1 | 2/2002 | Thiers |
| 2002/0020127 | A1 | 2/2002 | Thiers et al. |
| 2002/0031646 | A1 | 3/2002 | Chen et al. |
| 2002/0046528 | A1 | 4/2002 | Pervan et al. |
| 2002/0069611 | A1 | 6/2002 | Leopolder |
| 2002/0083673 | A1 | 7/2002 | Kettler et al. |
| 2002/0100231 | A1 | 8/2002 | Miller et al. |
| 2002/0178673 | A1 | 12/2002 | Pervan |
| 2002/0178674 | A1 | 12/2002 | Pervan |
| 2002/0178682 | A1 | 12/2002 | Pervan |
| 2003/0009972 | A1 | 1/2003 | Pervan et al. |
| 2003/0024199 | A1 | 2/2003 | Pervan et al. |
| 2003/0024200 | A1 | 2/2003 | Moriau et al. |
| 2003/0033777 | A1 | 2/2003 | Thiers et al. |
| 2003/0033784 | A1 | 2/2003 | Pervan |
| 2003/0041545 | A1 | 3/2003 | Stanchfield |
| 2003/0084636 | A1 | 5/2003 | Pervan |
| 2003/0101674 | A1 | 6/2003 | Pervan et al. |
| 2003/0115812 | A1 | 6/2003 | Pervan |
| 2003/0115821 | A1 | 6/2003 | Pervan |
| 2003/0196405 | A1 | 10/2003 | Pervan |
| 2003/0233809 | A1 | 12/2003 | Pervan |
| 2004/0016196 | A1 | 1/2004 | Pervan |
| 2004/0035078 | A1 | 2/2004 | Pervan |
| 2004/0068954 | A1 | 4/2004 | Martensson |
| 2004/0139678 | A1 | 7/2004 | Pervan |
| 2004/0177584 | A1 | 9/2004 | Pervan |
| 2004/0206036 | A1 | 10/2004 | Pervan |
| 2004/0241374 | A1 | 12/2004 | Thiers et al. |
| 2004/0255541 | A1 | 12/2004 | Thiers et al. |
| 2005/0034404 | A1 | 2/2005 | Pervan |
| 2005/0034405 | A1 | 2/2005 | Pervan |
| 2005/0055943 | A1 | 3/2005 | Pervan |
| 2005/0102937 | A1 | 5/2005 | Pervan |
| 2005/0138881 | A1 | 6/2005 | Pervan |
| 2005/0160694 | A1 | 7/2005 | Pervan |
| 2005/0166502 | A1 | 8/2005 | Pervan et al. |
| 2005/0166514 | A1 | 8/2005 | Pervan |
| 2005/0166516 | A1 | 8/2005 | Pervan |
| 2005/0193677 | A1 | 9/2005 | Vogel |
| 2005/0208255 | A1 | 9/2005 | Pervan |
| 2005/0210810 | A1 | 9/2005 | Pervan |

FOREIGN PATENT DOCUMENTS

| | | | |
|---|---|---|---|
| AU | 200020703 | A1 | 6/2000 |
| BE | 417526 | | 9/1936 |
| BE | 0557844 | | 6/1957 |
| BE | 1010339 | A3 | 6/1998 |
| BE | 1010487 | A6 | 10/1998 |
| CA | 0991373 | | 6/1976 |
| CA | 2226286 | | 12/1997 |
| CA | 2252791 | | 5/1999 |
| CA | 2289309 | | 7/2000 |
| CH | 200949 | | 1/1939 |
| CH | 211877 | | 1/1941 |
| CH | 690242 | A5 | 6/2000 |
| DE | 1 212 275 | | 3/1966 |
| DE | 7102476 | | 1/1971 |
| DE | 1 534 278 | | 11/1971 |
| DE | 2 159 042 | | 6/1973 |
| DE | 2 205 232 | | 8/1973 |
| DE | 7402354 | | 1/1974 |
| DE | 2 238 660 | | 2/1974 |
| DE | 2 252 643 | | 5/1974 |
| DE | 2 502 992 | | 7/1976 |
| DE | 2 616 077 | | 10/1977 |
| DE | 2 917 025 | | 11/1980 |
| DE | 30 41781 | A1 | 6/1982 |
| DE | 32 14 207 | A1 | 11/1982 |
| DE | 32 46 376 | C2 | 6/1984 |
| DE | 33 43 601 | A1 | 6/1985 |
| DE | 35 38 538 | A1 | 10/1985 |
| DE | 86 04 004 | | 6/1986 |
| DE | 35 12 204 | A1 | 10/1986 |
| DE | 35 44 845 | A1 | 6/1987 |
| DE | 36 31 390 | A1 | 12/1987 |
| DE | 40 02 547 | A1 | 8/1991 |
| DE | 41 30 115 | A1 | 9/1991 |
| DE | 41 34 452 | A1 | 4/1993 |
| DE | 42 15 273 | A1 | 11/1993 |
| DE | 42 42 530 | A1 | 6/1994 |
| DE | 43 13 037 | C1 | 8/1994 |
| DE | 93 17 191 | U1 | 3/1995 |
| DE | 296 10 462 | | 10/1996 |
| DE | 196 01 322 | A1 | 5/1997 |
| DE | 296 18 318 | U1 | 5/1997 |
| DE | 297 10 175 | U1 | 9/1997 |
| DE | 196 51 149 | A1 | 6/1998 |
| DE | 197 09 641 | A1 | 9/1998 |
| DE | 197 18 319 | A1 | 11/1998 |
| DE | 197 18 812 | A1 | 11/1998 |
| DE | 200 01 225 | U1 | 8/2000 |
| DE | 200 02 744 | U1 | 9/2000 |
| DE | 199 25 248 | A1 | 12/2000 |
| DE | 200 13 380 | | 12/2000 |
| DE | 200 17 461 | U1 | 3/2001 |
| DE | 200 18 284 | U1 | 3/2001 |
| DE | 100 01 248 | | 7/2001 |
| DE | 100 32 204 | C1 | 7/2001 |
| DE | 100 44 016 | A1 | 3/2002 |
| DE | 202 05 774 | U1 | 8/2002 |
| EP | 0 248 127 | A1 | 12/1987 |
| EP | 0 623 724 | A1 | 11/1994 |
| EP | 0 652 340 | A1 | 5/1995 |
| EP | 0 665 347 | | 8/1995 |
| EP | 0 690 185 | A1 | 1/1996 |
| EP | 0 698 162 | B1 | 2/1996 |
| EP | 0 843 763 | B1 | 5/1998 |
| EP | 0 849 416 | A2 | 6/1998 |
| EP | 0 855 482 | B1 | 7/1998 |

| | | | |
|---|---|---|---|
| EP | 0 877 130 | B1 | 11/1998 |
| EP | 0 958 441 | | 11/1998 |
| EP | 0 903 451 | A2 | 3/1999 |
| EP | 0 969 163 | A2 | 1/2000 |
| EP | 0 969 163 | A3 | 1/2000 |
| EP | 0 969 164 | A2 | 1/2000 |
| EP | 0 969 164 | A3 | 1/2000 |
| EP | 0 974 713 | A1 | 1/2000 |
| EP | 0 976 889 | | 2/2000 |
| EP | 1 048 423 | A2 | 11/2000 |
| EP | 1 120 515 | A1 | 8/2001 |
| EP | 1 146 182 | A2 | 10/2001 |
| EP | 1 223 265 | | 7/2002 |
| EP | 1 251 219 | A1 | 10/2002 |
| EP | 1 262 609 | | 12/2002 |
| FI | 843060 | | 8/1984 |
| FR | 1 293 043 | | 4/1962 |
| FR | 2 568 295 | | 1/1986 |
| FR | 2 630 149 | | 10/1989 |
| FR | 2 637 932 | A1 | 4/1990 |
| FR | 2 675 174 | | 10/1992 |
| FR | 2 691 491 | | 11/1993 |
| FR | 2 697 275 | | 4/1994 |
| FR | 2 712 329 | A1 | 5/1995 |
| FR | 2 781 513 | A1 | 1/2000 |
| FR | 2 785 633 | A1 | 5/2000 |
| FR | 2 810 060 | A1 | 12/2001 |
| GB | 240629 | | 10/1925 |
| GB | 424057 | | 2/1935 |
| GB | 585205 | | 1/1947 |
| GB | 599793 | | 3/1948 |
| GB | 636423 | | 4/1950 |
| GB | 812671 | | 4/1959 |
| GB | 1127915 | | 10/1968 |
| GB | 1171337 | | 11/1969 |
| GB | 1237744 | | 6/1971 |
| GB | 1275511 | | 5/1972 |
| GB | 1430423 | | 3/1976 |
| GB | 2117813 | A | 10/1983 |
| GB | 2126106 | A | 3/1984 |
| GB | 2243381 | A | 10/1991 |
| GB | 2256023 | A | 11/1992 |
| JP | 54-65528 | | 5/1979 |
| JP | 57-119056 | | 7/1982 |
| JP | 57-185110 | | 11/1982 |
| JP | 59-186336 | | 11/1984 |
| JP | 3-169967 | | 7/1991 |
| JP | 4-106264 | | 4/1992 |
| JP | 4-191001 | | 7/1992 |
| JP | 5-148984 | | 6/1993 |
| JP | 6-56310 | | 5/1994 |
| JP | 6-146553 | | 5/1994 |
| JP | 6-320510 | | 11/1994 |
| JP | 7-076923 | | 3/1995 |
| JP | 7-180333 | | 7/1995 |
| JP | 7-300979 | | 11/1995 |
| JP | 7-310426 | | 11/1995 |
| JP | 8-109734 | | 4/1996 |
| JP | 9-38906 | | 2/1997 |
| JP | 9-88315 | | 3/1997 |
| JP | 2000-179137 | | 6/2000 |
| JP | P2000 226932 | | 8/2000 |
| JP | 2001-173213 | | 6/2001 |
| JP | 2001 179710 | | 7/2001 |
| JP | 2001 254503 | | 9/2001 |
| JP | 2001 260107 | | 9/2001 |
| JP | P2001 329681 | | 11/2001 |
| NL | 7601773 | | 8/1976 |
| NO | 157871 | | 7/1984 |
| NO | 305614 | | 5/1995 |
| PL | 24931 | U | 11/1974 |
| SE | 372 051 | | 5/1973 |
| SE | 450 141 | | 6/1984 |
| SE | 501 014 | C2 | 10/1994 |
| SE | 502 994 | | 3/1996 |
| SE | 506 254 | C2 | 11/1997 |
| SE | 509 059 | | 6/1998 |
| SE | 509 060 | | 6/1998 |
| SE | 512 290 | | 12/1999 |
| SE | 512 313 | | 12/1999 |
| SE | 0000200-6 | | 7/2001 |
| SU | 363795 | | 11/1973 |
| WO | WO84/02155 | | 6/1984 |
| WO | WO87/03839 | A1 | 7/1987 |
| WO | WO92/17657 | | 10/1992 |
| WO | WO93/13280 | | 7/1993 |
| WO | WO94/01628 | | 1/1994 |
| WO | WO94/26999 | | 11/1994 |
| WO | WO96/27719 | | 9/1996 |
| WO | WO96/27721 | | 9/1996 |
| WO | WO96/30177 | A1 | 10/1996 |
| WO | 97/19232 | | 5/1997 |
| WO | WO97/47834 | | 12/1997 |
| WO | WO98/22677 | A1 | 5/1998 |
| WO | WO98/24994 | | 6/1998 |
| WO | WO98/24995 | | 6/1998 |
| WO | WO98/38401 | A1 | 9/1998 |
| WO | WO99/40273 | A1 | 8/1999 |
| WO | WO99/66151 | | 12/1999 |
| WO | WO99/66152 | | 12/1999 |
| WO | WO 00/06854 | | 1/2000 |
| WO | WO 00/20705 | A1 | 4/2000 |
| WO | WO 00/20706 | A1 | 4/2000 |
| WO | WO 00/66856 | A1 | 11/2000 |
| WO | WO 01/02669 | A1 | 1/2001 |
| WO | 01/07729 | | 2/2001 |
| WO | WO 01/66876 | A1 | 9/2001 |
| WO | WO 01/66877 | A1 | 9/2001 |
| WO | WO 01/75247 | A1 | 10/2001 |
| WO | WO 01/77461 | A1 | 10/2001 |
| WO | 01/96688 | | 12/2001 |
| WO | 01/98603 | | 12/2001 |
| WO | WO 01/98604 | A1 | 12/2001 |
| WO | 02/060691 | | 8/2002 |

OTHER PUBLICATIONS

Darko Pervan et al., U.S. Appl. No. 10/508,198 entitled "Floorboards With Decorative Grooves" filed Sep. 20, 2004.

Darko Pervan, U.S. Appl. No. 10/509,885 entitled "Mechanical Locking System for Floorboards" filed Oct. 4, 2004.

Darko Pervan, U.S. Appl. No. 10/510,580 entitled "Floorboards for Floorings" filed Oct. 8, 2004.

Darko Pervan, U.S. Appl. No. 10/970,282 entitled "Mechanical Locking System for Floor Panels" filed Oct. 22, 2004.

Darko Pervan, U.S. Appl. No. 11/000,912 entitled "Floorboard, System and Method for Forming a Flooring, and Flooring Formed Thereof" filed Dec. 2, 2004.

Darko Pervan, U.S. Appl. No. 10/906,356 entitled "Building Panel With Compressed Edges and Method of Making Same" filed Feb. 15, 2005.

Darko Pervan, U.S. Appl. No. 11/092,748 entitled "Mechanical Locking System for Panels and Method of Installing Same" filed Mar. 30, 2005.

Darko Pervan, U.S. Appl. No. 10/908,658 entitled "Mechanical Locking System for Floor Panels" filed May 20, 2005.

Webster's Dictionary, Random House: New York (1987), p. 862.

Knight's American Mechanical Dictionary, Hurd and Houghton: New York (1876), p. 2051.

Opposition EP 0.698,162 B1—Facts-Grounds-Arguments, dated Apr. 1, 1999, pp. 1-56.

Opposition II EP 0.698,162 B1—Facts-Grounds-Arguments, dated Apr. 30, 1999, (17 pages)—with translation (11 pages).

Opposition I: Unilin Decor N.V./Välinge Aluminum AB, communication dated Jun. 8, 1999 to European Patent Office, pp. 1-2.

Opposition I: Unilin Decor N.V./Välinge Aluminum AB, communication dated Jun. 16, 1999 to European Patent Office, pp. 1-2.
FI Office Action dated Mar. 19, 1998.
NO Office Action Dated Dec. 22, 1997.
NO Office Action dated Sep. 21, 1998.
Opposition EP 0.877.130 B1—Facts—Arguments, dated Jun. 28, 2000, pp. 1-13.
RU Application Letter dated Sep. 26, 1997.
NZ Application Letter dated Oct. 21, 1999.
European prosecution file history to grant, European Patent No. 94915725.9-2303/0698162, grant date Sep. 17, 1998.
European prosecution file history to grant, European Patent No. 98106535.2-2303/0855482, grant date Dec. 1, 1999.
European prosecution file history to grant, European Patent No. 98201555.4-2303/0877130, grant date Jan. 26, 2000.
Communication of Notices of Intervention by E.F.P. Floor Products dated Mar. 17, 2000 in European Patent Application 0698162, pp. 1-11 with annex pp. 1-21.
Response to the E.F.P. Floor Products intervention dated Jun. 28, 2000, pp. 1-5.
Letters from the Opponent dated Jul. 26, 2001 and Jul. 30, 2001 including Annexes 1 to 3.
Communication from European Patent Office dated Sep. 20, 2001 in European Patent No. 0698162, pp. 1-2 with Facts and Submissions Annex pp. 1-18, Minutes Annex pp. 1-11, and Annex I to VI.
Communication from Swedish Patent Office dated Sep. 21, 2001 in Swedish Patent No. 9801986-2, pp. 1-3 in Swedish with forwarding letter dated Sep. 24, 2001 in English.
Välinge, "Fibo-Trespo" Brochure, Distributed at the Domotex Fair In Hannover, Germany, Jan. 1996.
Träindustrins Handbook "Snickeriarbete", 2nd Edition, Malmö 1952, pp. 826, 827, 854, and 855, published by Teknografiska Aktiebolaget, Sweden.
"Träbearbetning", Anders Grönlund, 1986, ISBN 91-970513-2-2, pp. 357-360, published by Institutet for Trateknisk Forskning, Stockholm, Sweden.
Drawing Figure 25/6107 from Buetec Gmbh dated Dec. 16, 1985.
Pamphlet from Serexhe for Compact-Praxis, entitled "Selbst Teppichböden, PVC und Parkett verlegen", Published by Compact Verlag, München, Germany 1985, pp. 84-87.
Pamphlet from Junckers Industrser A/S entitled"Bøjlesystemet til Junckers boliggulve" Oct. 1994, Published by Junckers Industrser A/S, Denmark.
Pamphlet from Junckers Industrser A/S entitled "The Clip System for Junckers Sports Floors", Annex 7, 1994, Published by Junckers Industrser A/S, Denmark.
Pamphlet from Junckers Industrser A/S entitled "The Clip System for Junckers Domestic Floors", Annex 8, 1994, Published by Junckers Industrser A/S, Denmark.
Fibo-Trespo Alloc System Brochure entitled "Opplæring OG Autorisasjon", pp. 1-29, Fibo-Trespo.
"Revolution bei der Laminatboden-Verl", boden wand decke, vol. No. 11 of 14, Jan. 10, 1997, p. 166.
Kährs Focus Extra dated Jan. 2001, pp. 1-9.
Brochure for CLIC Laminate Flooring, Art.-Nr. 110 11 640.
Brochure for Laminat-Boden "Clever-Click", Parador® Wohnsysteme.
Brochure for PERGO®, CLIC Laminate Flooring, and Prime Laminate Flooring from Bauhaus, The Home Store, Malmö, Sweden.
Darko Pervan, U.S. Appl. No. 09/714,514 entitled "Locking System and Flooring Board" filed Nov. 17, 2000.

*PRIOR ART*

*PRIOR ART*

*PRIOR ART*

METHOD OF MAKING A FLOORBOARD AND METHOD OF MAKING A FLOOR WITH THE FLOORBOARD

CROSSREFERENCE TO RELATED APPLICATIONS

The present application is a divisional application of U.S. patent application Ser. No. 10/235,940, filed on Sep. 6, 2002 now U.S. Pat. No. 7,127,860, which application claims the benefit of Swedish Application SE 0103130-1, filed on Sep. 20, 2001. The disclosures in both these applications are incorporated herein by reference.

TECHNICAL FIELD

The invention relates generally to the technical field of locking systems for floorboards. The invention concerns on the one hand a locking system for floorboards which can be joined mechanically in different patterns and, on the other hand, floorboards provided with such a locking system and various methods of installation. The invention is particularly suited for use in mechanical locking systems integrated with the floorboard, for instance, of the types described and shown in WO94/26999, WO96/47834, WO96/27721, WO99/66151, WO99/66152, WO00/28171, SE0100100-7 and SE0100101-5 which are herewith incorporated by reference, but is also usable in other joint systems for joining of flooring. More specifically, the invention relates to locking systems which enable laying of mainly floating floors in advanced patterns.

The present invention is particularly suited for use in floating wooden floors, such as massive wooden floors or parquet floors. These types of floor often consist of a surface layer, a core and a balancing layer and are formed as rectangular floorboards intended to be joined along both long sides and short sides.

BACKGROUND OF THE APPLICATION

The following description of prior-art technique, problems of known systems as well as the object and features of the invention will therefore as non-limiting examples be aimed mainly at this field of application. However, it should be emphasized that the invention can be used in optional floorboards which are intended to be joined in different patterns by means of a mechanical joint system. The invention may thus also be applicable to homogeneous wooden floors, laminate floors with a surface of laminate and a core of e.g. fiberboard and floors with a surface of plastic and/or cork and the like.

Traditional parquet floors are usually laid in a floating manner, i.e. without glue, on an existing subfloor which does not have to be quite smooth or plane. Any irregularities are eliminated by means of underlay material in the form of e.g. cardboard, cork or foam plastic which is laid between the floorboards and the subfloor. Floating floors of this kind are usually joined by means of glued tongue-and-groove joints, (i.e. joints with a tongue on one floorboard and a tongue groove on an adjoining floorboard) on long side and short side. In laying, the boards are joined horizontally, a projecting tongue along the joint edge of one board being inserted into a tongue groove along the joint edge of an adjoining board. The same method is used on long side as well as short side, and the boards are usually laid in parallel both long side against long side and short side against short side.

In addition to such traditional floors which are joined by means of glued tongue/tongue groove joints, floorboards have been developed in recent years, which do not require the use of glue but which are instead joined mechanically by means of so-called mechanical joint systems. These systems comprise locking means which lock the boards horizontally and vertically. The mechanical joint systems can be formed by machining the core of the board. Alternatively, parts of the locking system can be made of a separate material which is integrated with the floorboard, i.e. already joined with a floorboard in connection with the manufacture thereof at the factory. The floorboards are joined, i.e. interconnected or locked together, by various combinations of angling, snapping-in and insertion along the joint edge in the locked position. By interconnection is here meant that floorboards with connecting means are mechanically interconnected in one direction, for instance horizontally or vertically. By locking-together, however, is meant that the floorboards are locked both in the horizontal and in the vertical direction.

The principal advantages of floating floors with mechanical joint systems are that they can be laid quickly and easily by different combinations of inward angling and snapping-in. They can also easily be taken up again and be reused in some other place.

All currently existing mechanical joint systems and also floors intended to be joined by gluing have vertical locking means which lock the floorboards across the surface plane of the boards. The vertical locking means consist of a tongue which enters a groove in an adjoining floorboard. The boards thus cannot be joined groove against groove or tongue against tongue. Also the horizontal locking system as a rule consists of a locking element on one side which cooperates with a locking groove on the other side. Thus the boards cannot be joined locking element against locking element or locking groove against locking groove. This means that the laying is in practice restricted to parallel rows. Using this technique, it is thus not possible to lay traditional parquet patterns where the boards are joined long side against short side in (herringbone pattern) or in different forms of diamond patterns.

Such advanced patterns have originally been laid by a large number of wood blocks of a suitable size and shape being glued to a subfloor, according to a desired pattern, possibly followed by grinding to obtain an even floor surface and finishing in the form of e.g. varnish or oil. The wood blocks according to this technique have no locking means whatever, since they are fixed by gluing to the subfloor.

Another known method of laying advanced patterns implies that the wood blocks are formed with a groove along all edges of the block. When the wood blocks are then laid, tongues are inserted into the grooves in the positions required. This results in a floor where the wood blocks are locked in the vertical direction relative to each other by the tongue engaging in tongue grooves of two adjoining wood blocks. Optionally this method is supplemented with gluing to lock the floor in the horizontal directions and to lock the floor in the vertical direction relative to the subfloor.

U.S. Pat. No. 1,787,027 (Wasleff) discloses another system for laying a herringbone parquet floor. The system comprises a plurality of wood blocks which are laid on a subfloor to form a herringbone parquet floor. Each wood block is provided with a set of tongues and tongue grooves which extend over parts of each edge of the wood block. When the wood blocks are laid in a herringbone pattern, tongues and tongue grooves will cooperate with each other so that the wood blocks are locked together mechanically in both the vertical and the horizontal direction. The tongues and tongue grooves that are shown in Wasleff, however, are of a classical type, i.e. they cannot be snapped or angled together, and the locking effect is achieved only when a plurality of wood blocks are laid together to form a floor. The system according to Wasleff consists of two types of wood blocks, which are mirror inverted relative to each other as regards the location of tongues and tongue grooves. The design of the locking system is such that a shank-end mill is necessary to form the tongue grooves shown. This is a drawback since machining using a shank-end mill is a relatively slow manufacturing operation.

U.S. Pat. No. 4,426,820 (Terbrack) discloses that floorboards can be joined long side against short side if the floor consists of two different floorboards which a joint system which can be laid merely by inward angling, which is not displaceable in the locked position and in which floorboards cannot be joined by snapping-in. Moreover FIGS. 11 and 23 show floorboards which are mirror inverted relative to each other. This is, however, not discussed in detail in the description. Col. 5, lines 10-13, seems to contain an indication that it is possible to join short side and long side. However, it is not shown how a complete floor can be joined using such floorboards to form a pattern. Owing to the non-existence of displaceability in the joined position and snappability, it is not possible to create, using such floorboards as disclosed by Terbrack, a floor of the type at which the present invention aims.

U.S. Pat. No. 5,295,341 (Kajiwara) discloses snappable floorboards which have two different long sides. One part of the long side is formed with a groove part and another part with a tongue part. Nor are such floorboards displaceable in the locked position. The manufacture is complicated, and nor can they be used to provide the desired pattern.

Boden Wand Decke (Domotex, January 1997) shows a laminate floor where floorboards with different surfaces have been joined to form a floor having a simple pattern. It is also shown that floorboards have been joined long side against short side, but only in such a manner that all the short sides which are joined with a long side extend along a straight line. Consequently, this is an application of a prior-art system.

OBJECTS AND SUMMARY

An object of the present invention is to provide floorboards, joint systems, methods of installation, methods of production and a method of disassembly, which make it possible to provide a floor which consists of rectangular floorboards which are joined mechanically in advanced patterns long side against short side and which can be disassembled and reused. The terms long side and short side are used to facilitate understanding. According to the invention, the boards can also be square or alternatingly square and rectangular, and optionally also exhibit different patterns or other decorative features in different directions.

This object is achieved wholly or partly by systems according to claims 1 and 16, respectively, a flooring according to claim 23, a set of floorboards according to claim 25 or 26, fitting pieces according to claim 28, a locking strip according to claim 30, production methods according to claim 31 or 32, installation methods according to claims 3, 40, 50 and 54, respectively, a gripping tool according to claim 67, and a method of disassembly according to claim 70. The dependent claims define particularly preferred embodiments of the invention.

According to a first aspect, the present invention comprises a system for making a flooring which comprises quadrangular floorboards which are mechanically lockable, in which system the individual floorboards along their four edge portions have pairs of opposing connecting means for locking together similar, adjoining floorboards both vertically and horizontally (D1 and D2 respectively), and wherein the connecting means of the floorboards are designed so as to allow locking-together in a first direction in the plane of the floorboard by at least snapping-in and locking-together in a second direction in the plane of the floorboard by inward angling and/or snapping-in. Moreover the system comprises two different types of floorboard A and B respectively, the connecting means of one type of floorboard A along one pair of opposite edge portions being arranged in a mirror-inverted manner relative to the corresponding connecting means along the same pair of opposite edge portions of the other type of floorboard B.

An advantage of the present invention is that floorboards can be laid long side against short side in advanced patterns and that joining can be made quickly and easily in all the laying alternatives that may be used when laying in all four directions from a center.

The mirror-inverted joint systems need not be identical to allow joining. Surfaces that are not active in the vertical and horizontal locking means may, for instance, have a deviating shape. For example, the outer part of the tongue and the inner part of the groove may be varied.

According to a second aspect, the present invention comprises a system for making a flooring, which comprises quadrangular floorboards which are mechanically lockable, in which system the individual floorboards along their four edge portions have pairs of opposing connecting means for joining together similar, adjoining floorboards at least vertically, and wherein the pairs of opposing connecting means of the floorboards at least in a first direction in the plane of the floorboard are designed so as to allow locking-together both horizontally and vertically by inward angling and/or snapping-in. Moreover also this system comprises two different types of floorboard, the connecting means of one type of floorboard along one pair of opposite edge portions being arranged in a mirror-inverted manner relative to the corresponding connecting means along the same pair of opposite edge portions of the other type of floorboard.

According to a third aspect, the present invention comprises a flooring, which is formed by means of one of the systems described above. According to a fourth aspect, the present invention comprises a set of floorboards for making such a flooring. Such a set may be advantageous in terms of distribution since a customer, by buying such a set, can obtain a set of floorboards which are adjusted to each other. This is particularly advantageous if variations may appear in the manufacturing process as regards, for instance, the color of the surface or the tolerances of the connecting means.

According to a fifth aspect, the present invention comprises fitting pieces, which have at least one oblique edge and which along their edge portions have connecting means for cooperation with adjoining floorboards. Such fitting pieces may constitute an important aid in installation of a floor with an advanced pattern, such as a herringbone pattern, by the possibility of quickly and efficiently laying floorboards at an angle other than 90(with each other. Since also the fitting pieces are provided with connecting means, a herringbone flooring can be obtained, where both the frame and the actual herringbone pattern are mechanically locked together so that the entire floor is held together mechanically.

According to a sixth aspect, the invention comprises a locking strip for interconnecting floorboards provided with identical locking means. This can be an aid, for instance, in the cases where a fitting piece is not available or if one chooses to form all fitting pieces with identical connecting means all the way round, for instance with a view to reducing the number of variants of fitting pieces.

According to a seventh aspect, the present invention comprises a method for rational production of floorboards which have a system as described above.

An advantage of identical and mirror-inverted joint systems according to the invention is that the floorboards can be produced rationally although they consist of two different types, for instance boards of type A and boards of type B which have identical but mirror-inverted-joint systems on long side and short side compared with the boards of type A. All long sides of A and B boards can be machined, for instance, in a first machine. Then the A boards proceed to another machine where the short sides are machined. The boards that are to be provided with mirror-inverted joint systems, for instance the B boards, are however rotated through 180( in the same plane before machining of the short sides. Thus the two types of board A and B can be manufactured using the same machines and the same set of tools.

According to an eighth aspect, the present invention comprises four alternative or supplementary methods for laying a flooring using the system above. Quick and efficient laying of a floor according to the present invention can be carried out by means of one of these methods.

According to a ninth and a tenth aspect, the present invention comprises a gripping tool as well as a method for disassembly of a flooring as described above.

If the length of the long side is a multiple of the length of the short side, for instance 1, 2, 3, 4 etc. times the length of the short side, symmetrical patterns can be produced. If the joint system can also be joined by angling, very quick installation can be carried out by, for instance, the long sides being laid by inward angling and the short sides by snapping-in.

The joint systems on long sides and short sides may consist of different materials or the same material having different properties, for instance wood or veneer of different wood materials or fiber directions or wood-based board materials such as HDF, MDF or different types of fiberboard. This may result in lower production costs and better function as regards inward angling, insertion along the joint edge, snapping-in and durability.

The invention will now be described in more detail with reference to the accompanying schematic drawings which by way of example illustrate currently preferred embodiments of the invention according to its different aspects.

BRIEF DESCRIPTION OF THE DRAWINGS

The objects and advantages of the invention will become apparent from the following detailed description of preferred embodiments thereof in connection with the accompanying drawings in which like numerals designate like elements and in which:

FIGS. 2*a-e* show a known floorboard which can be laid by angling and snapping-in.

DETAILED DESCRIPTION OF PREFERRED EMBODIMENTS

Figure 1A:
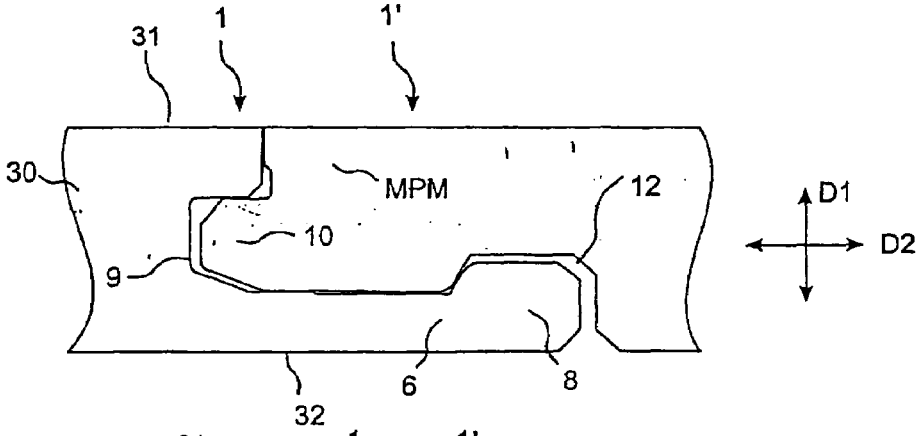
FIGS. 1*a-e* show prior-art joint systems.

In the following description, the two types of floorboard according to the invention will be designated A and B, respectively. This aims merely at illustrating the cooperation between two types of floorboard. Which type of board is designated A and B respectively is immaterial to the invention.

FIGS. 1*a-e* illustrate floorboards 1, 1 (with a surface 31, a core 30 and a rear side 32, whose joint edge portions are provided with prior-art mechanical joint systems. The vertical locking means comprise a groove 9 and a tongue 10. The horizontal locking means comprise locking elements 8 which cooperate with locking grooves 12. The joint systems according to FIGS. 1*a* and 1*c* have on the rear side 32 a strip 6 which supports or is formed integrally with the locking element 8. The locking systems according to FIGS. 1*b, d* and *e* are distinguished by the locking element 8 and the locking groove 12 being formed in the groove/tongue. The locking systems according to FIGS. 1*a*-1*c* can be joined by inward angling, insertion along the joint edge and snapping-in, whereas the locking systems according to FIGS. 1*d* and 1*e* can only be joined by horizontal snapping-in.

Figure 2B:
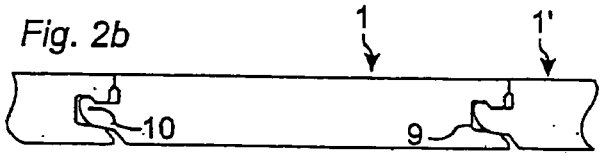
Figure 2A:
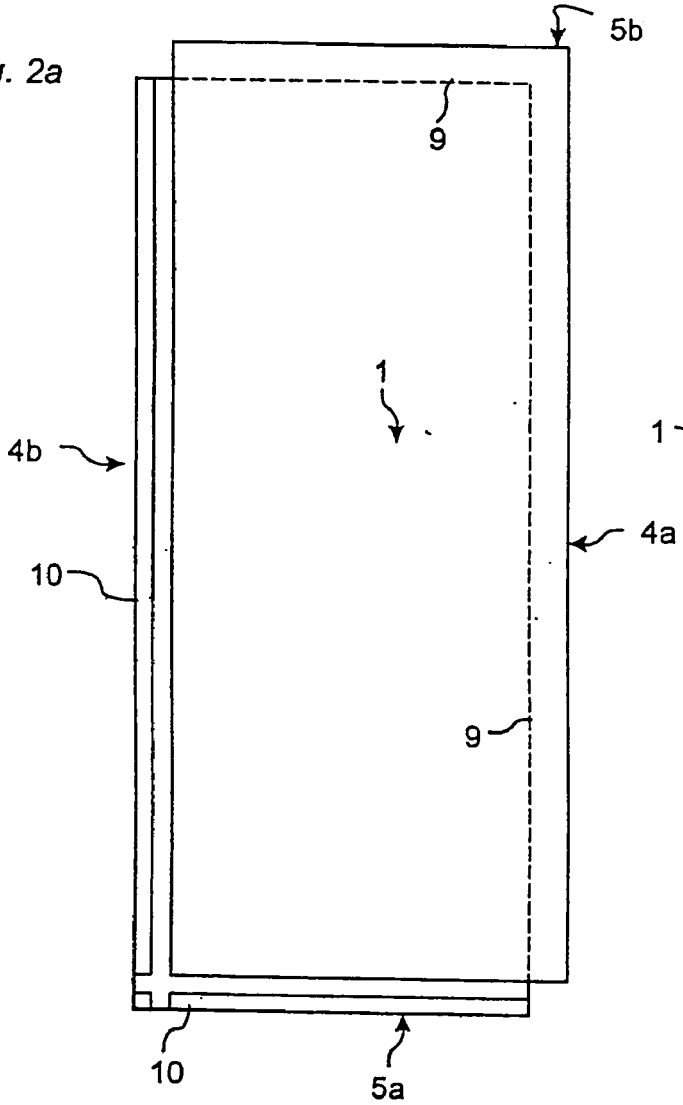
Figure 2C:
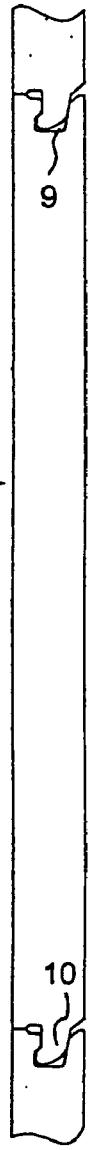
Figure 2D:
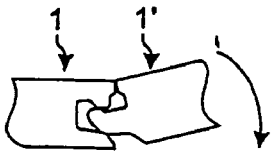
Figure 2E:
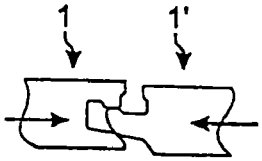

FIGS. 2*a-e* show a known floorboard 1 with known mechanical joint systems which can be joined with another identical floorboard 1 (by angling, insertion along the joint edge (FIG. 2*d*) or snapping-in (FIG. 2*e*). Floorboards of this type can only be joined with the long side 4*a* against the long side 4*b* since it is not possible to join tongue 10 against tongue or groove 9 against groove. The same applies to the short sides 5*a* and 5*b*.

Figure 3A:
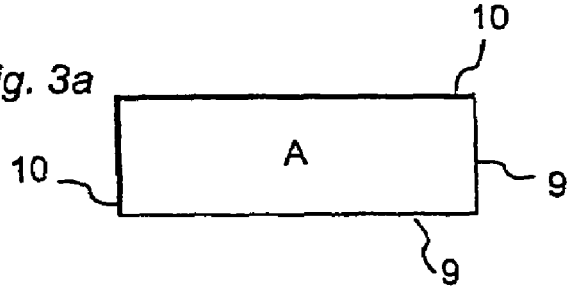
FIGS. 3*a-b* show laying in parallel rows according to prior-art technique.
Figure 3B:
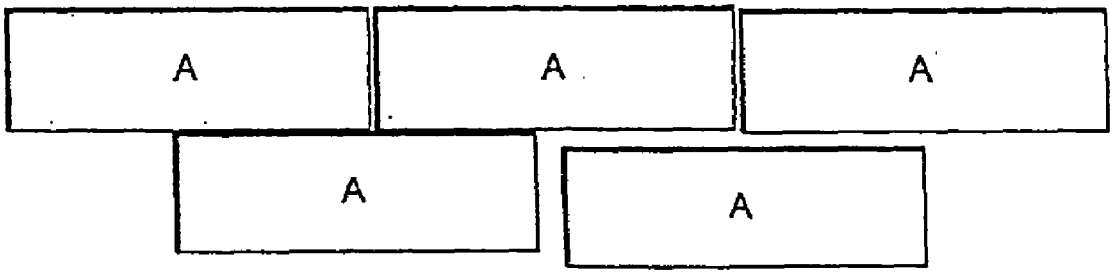

FIGS. 3*a-b* show a known installation method and a known laying pattern. In FIG. 3*a*, the tongue side 10 on long side and short side is indicated with a thick line. The method which is used today in installation of wood and laminate flooring with mechanical connecting means is shown in FIG. 3*b*. Identical boards are laid in parallel rows with offset short sides.

Figure 4A:
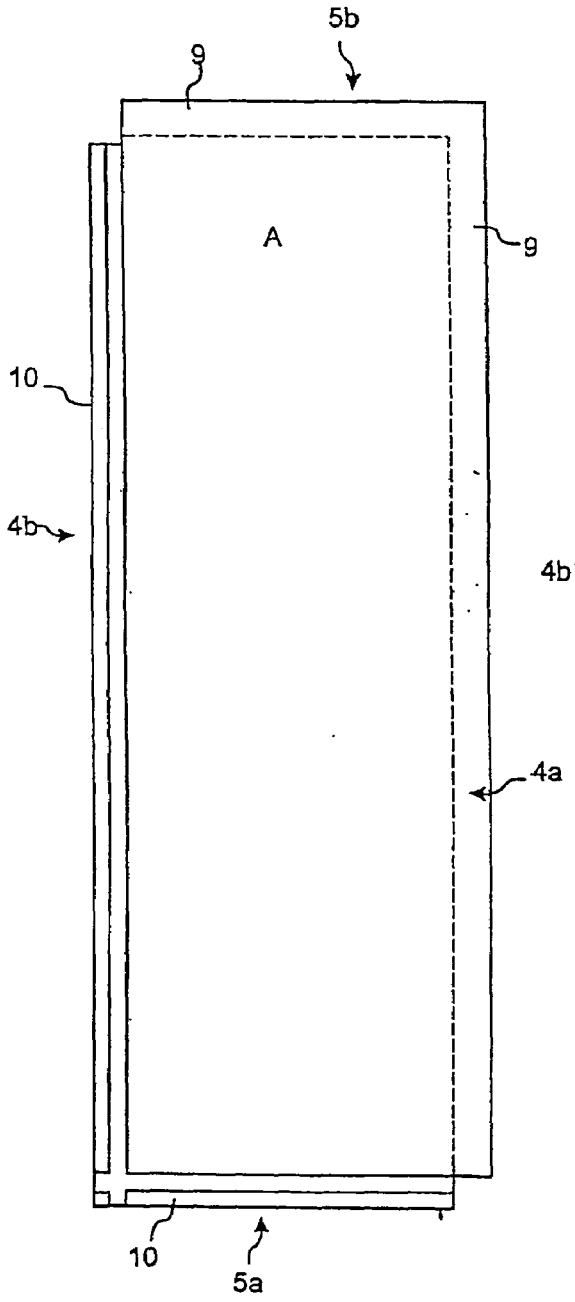
FIGS. 4*a-b* show a floorboard with a mirror-inverted joint system according to the invention.
Figure 4B:
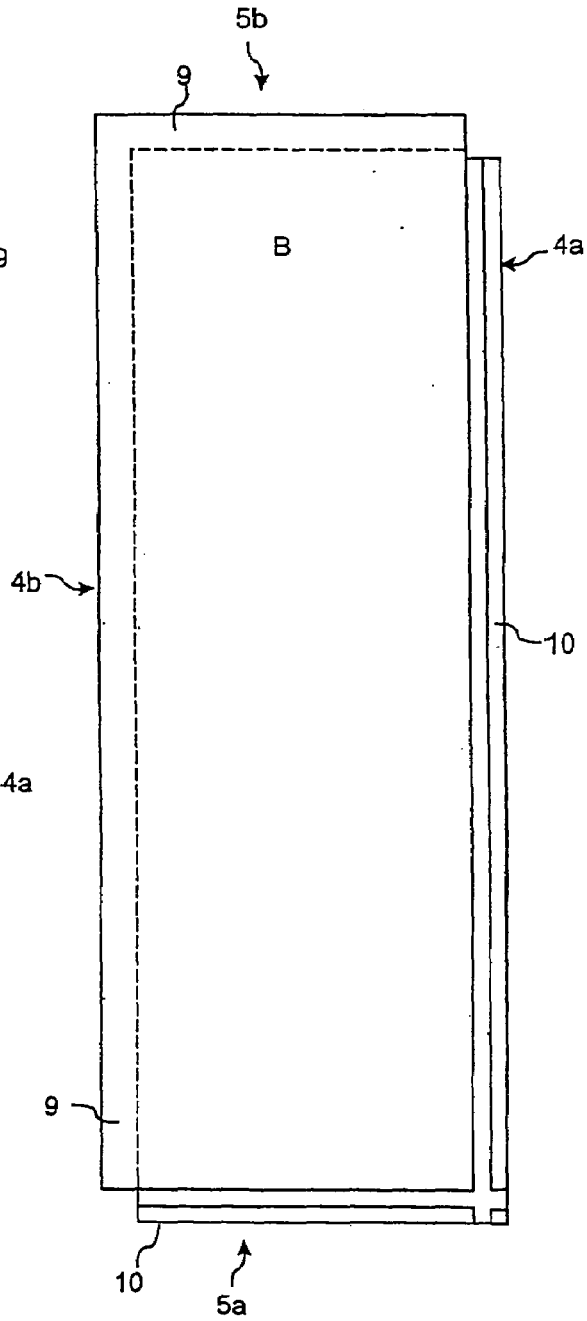

FIGS. 4*a*-4*b* show two rectangular floorboards which are of a first type A and a second type B according to the invention and whose long sides 4*a* and 4*b* in this embodiment are of a length which is 3 times the length of the short sides 5*a*, 5*b*. The floorboards have a first pair of vertical and horizontal locking means, also called connecting means, which cooperate with a second pair of vertical and horizontal locking means. The two types are in this embodiment identical except that the location of the location of the locking means is mirror-inverted. The locking means 9, 10 allow joining of long side against short side when the first pair of locking means 9 is joined with the second pair of locking means. In this embodiment, joining can take place by both snapping-in and inward angling, but also insertion along the joint edge. Several variants may be used. The two types of floorboards need not be of the same format, and the locking means can also be of different shapes provided that, as stated above, they can be joined long side against short side. The connecting means can be made of the same material or different materials or be made of the same material but with different material properties. For example, the connecting means can be made of plastic or metal. They can also be made of the same material as the floorboard, but subjected to a property modifying treatment, such as impregnation or the like.

Figure 5A:
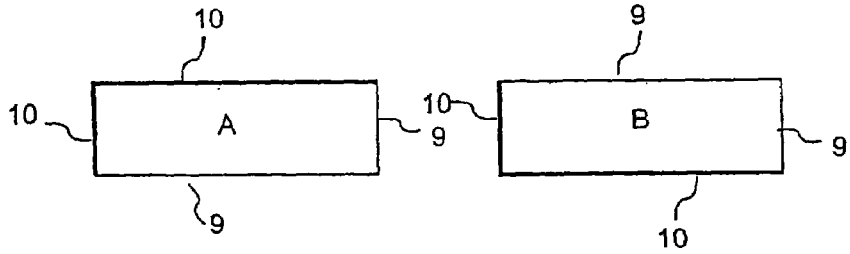
FIGS. 5*a-b* show laying of flooring according to the invention.
Figure 5B:
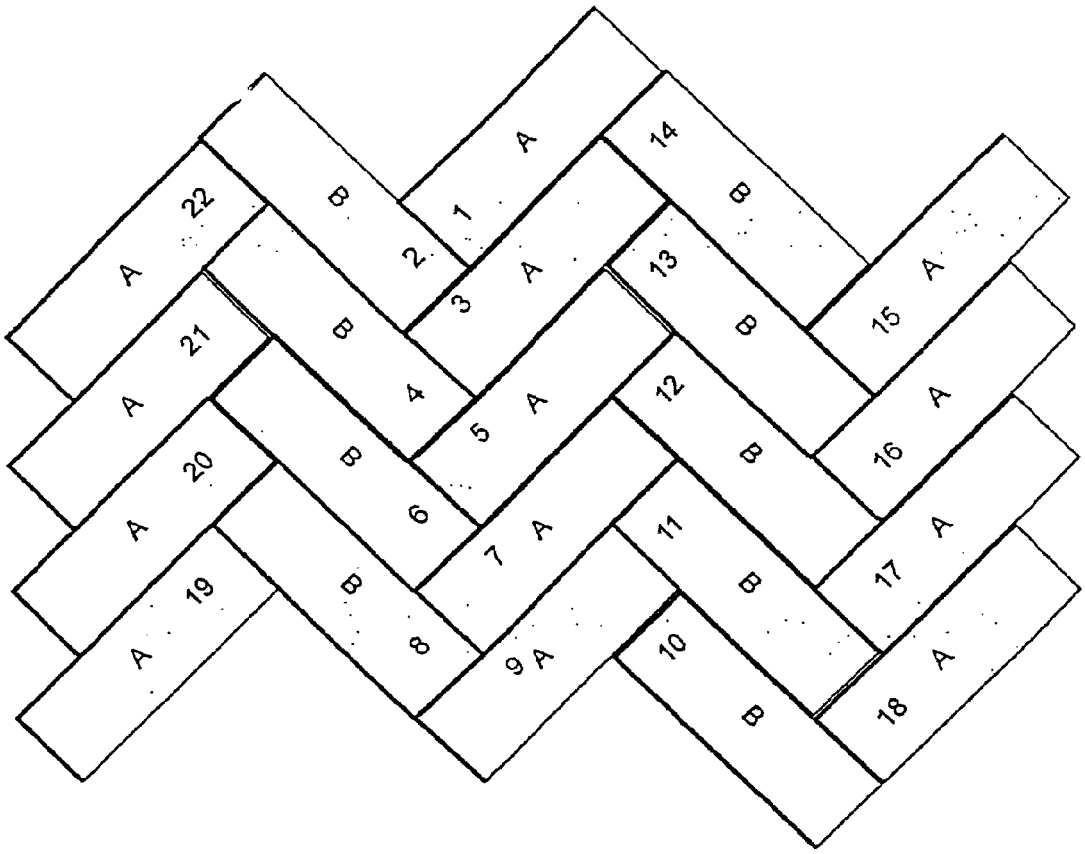

FIGS. 5*a*-5*b* show a floor according to the invention which consists of floorboards according to FIGS. 4*a* and 4*b*, which are joined in a herringbone pattern long side against short side. The laying sequence can be, for instance, the one shown in FIG. 5, where the boards are laid in the number series from 1 to 22.

The invention is applicable to floorboards of many different sizes. For example, the floorboards may be approximately the same size as the wood blocks in a traditionally patterned parquet floor. However, it is also possible to apply the invention to floorboards of the size that is today frequent on the market for parquet or laminate floors. Other sizes are also conceivable. It is also possible that boards of different types (for instance A and B) be given different sizes for creating different types of pattern.

FIGS. 6-8 show different methods for installation of herringbone pattern floors using floorboards. LD designates in all Figures the direction of laying.

Figure 6A:
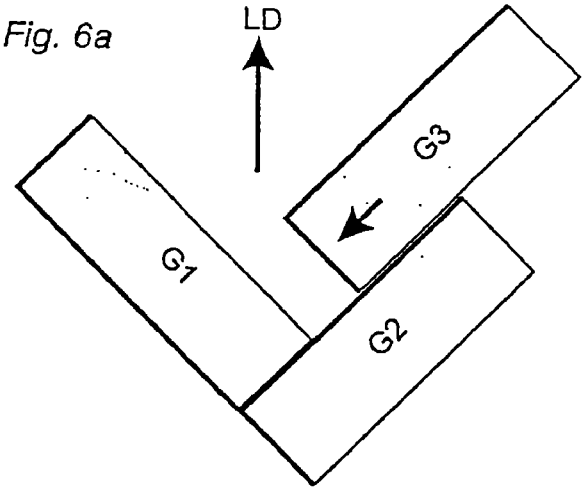
FIGS. 6*a-c* show a first installation method according to the present invention.

FIG. 6 shows a first installation method. In FIG. 6*a*, a first floorboard G1 and a second floorboard G2 are interconnected and possibly locked together long side against short side. The interconnection can here take place by either snapping-in, insertion along the joint edge or inward angling. Such inward angling takes place by rotation about an essentially horizontal axis. A third floorboard G3 is added by first being connected and locked long side against long side with the floorboard G2 and then in the locked state being displaced along the floorboard G2 to be connected or locked with its short side against the floorboard G1. The connection with the floorboard G2 can take place by inward angling or snapping-in while the connection with the floorboard G2 takes place by snapping-in.

Figure 6B:
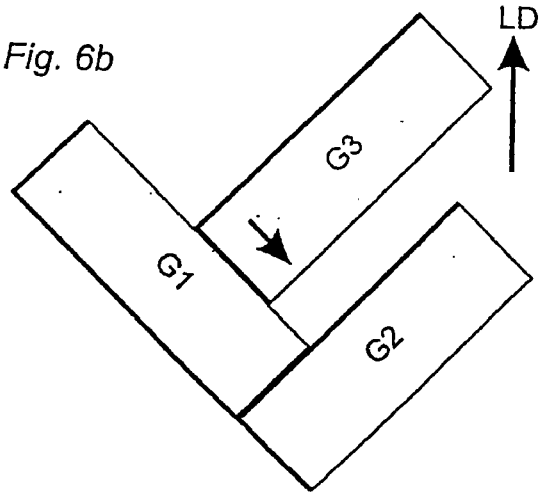

FIG. 6*b* shows an alternative way of adding the third floorboard G3, in which case the floorboard G3 is first connected with its short side against the long side of the floorboard G1 and then displaced in the locked state along the floorboard G1 and connected or locked together by snapping together with the floorboard G2. The method according to FIG. 6*a* and FIG. 6*b* yields essentially the same result.

Figure 6C:
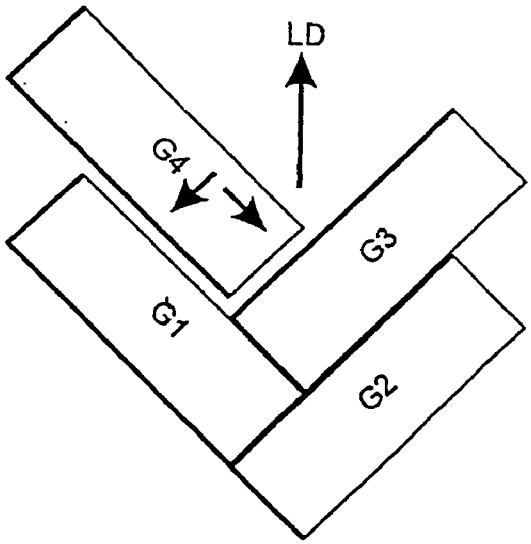

FIG. 6*c* shows how a further floorboard G4 is added in the same way as the floorboard G3 was added, i.e. either by the connecting sequence according to FIG. 6*a* or the connecting sequence according to FIG. 6*b*. Further floorboards can then be added by repeating these steps.

Figure 7A:
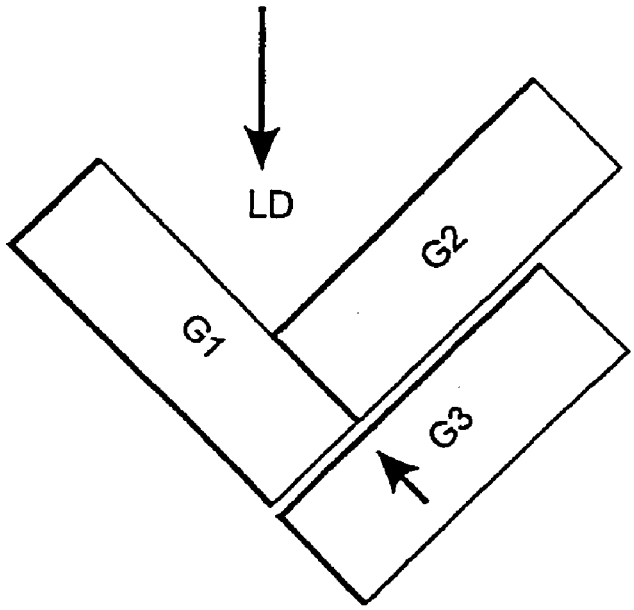
FIGS. 7*a-b* show a second installation method according to the present invention.
Figure 7B:
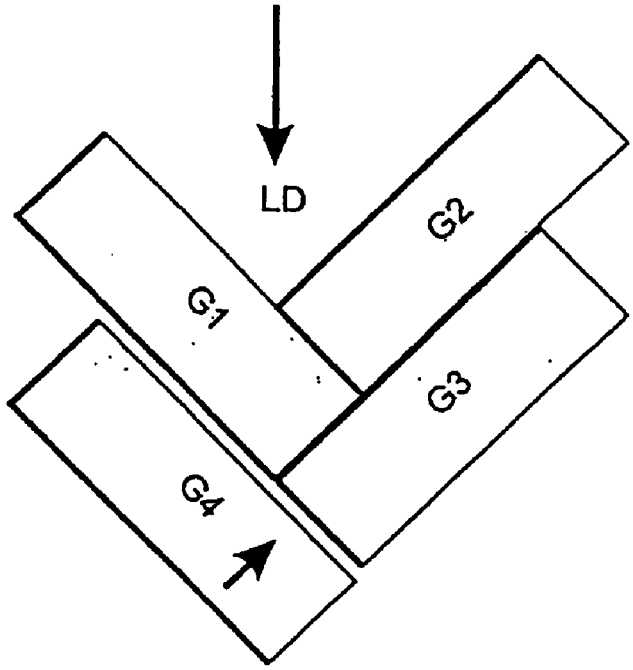

FIG. 7*a* shows a second installation method. In FIG. 7*a* two floorboards G1 and G2 are locked together or connected in the same way as in FIG. 6*a* above. Then the floorboard G3 is connected or locked together with the short side of the floorboard G1 and the long side of the floorboard G2, these short sides and long sides forming a uniform joint edge with essentially identical connecting means. Thus, the floorboard G3 can be connected and possibly locked together by either inward angling, insertion along the joint edge or snapping-in. The location of the floorboard G3 can possibly be adjusted by displacement of the floorboard along the joint edge so that its short side is aligned with the long side of the floorboard G1 and, together with this, forms a uniform joint edge. FIG. 7*b* shows how the floorboard G4 is joined with the common joint edge formed by the floorboards G1 and G3 in the same way as the floorboard G3 was added.

FIG. 8 shows a third installation method.

Figure 8A:
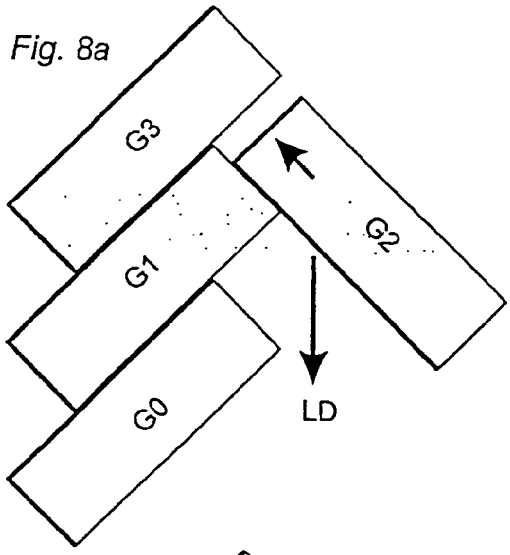
FIGS. 8*a-e* show a third installation method according to the present invention.

FIG. 8*a* shows how a plurality of floorboards G0, G1 and G3 are arranged and joined long side against long side, the short sides of the floorboards being displaced relative to each other. The displacement of the short side is preferably the same as the width of the floorboard G2. The displacement can be performed, for instance, by using fitting pieces as will be shown in more detail in FIG. 9. The adding of the floorboard G2 can be carried out in two ways.

FIG. 8*a* shows how the long side of the floorboard G2 is first joined by inward angling, insertion or snapping-in with the short side of the floorboard G1. Then the floorboard G2 is displaced in the connected state along the short side of the floorboard G1 until the short side of the floorboard G2 is connected with the long side of the floorboard G3 by snapping-in.

Figure 8D:
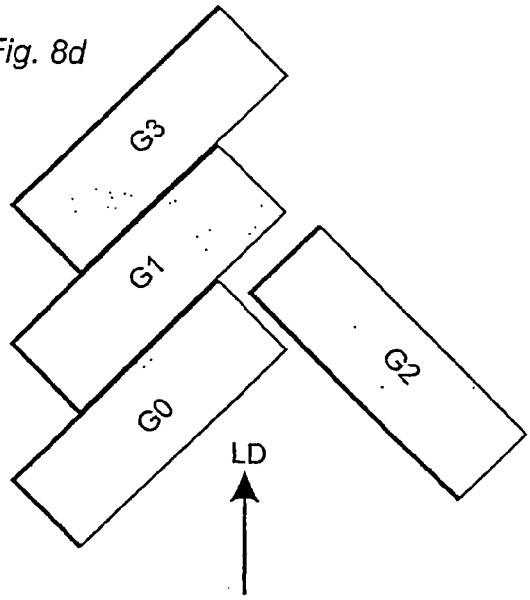
Figure 8B:
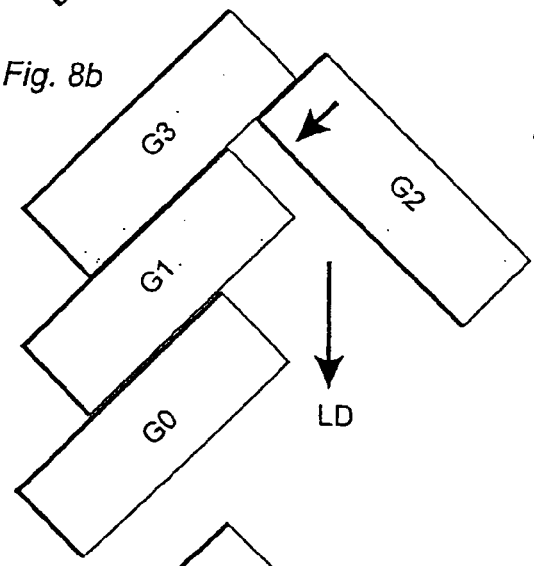

FIG. 8*b* shows the second way of adding the floorboard G2, i.e. its short side is first connected with the long side of the floorboard G3 by inward angling, insertion or snapping-in and then in the connected state displaced along the same until the long side of the floorboard G2 is connected with the short side of the floorboard G1 by snapping-in.

Figure 8E:
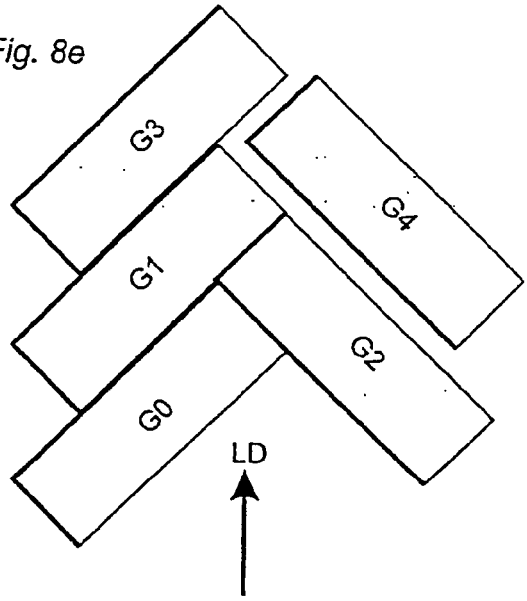
Figure 8C:
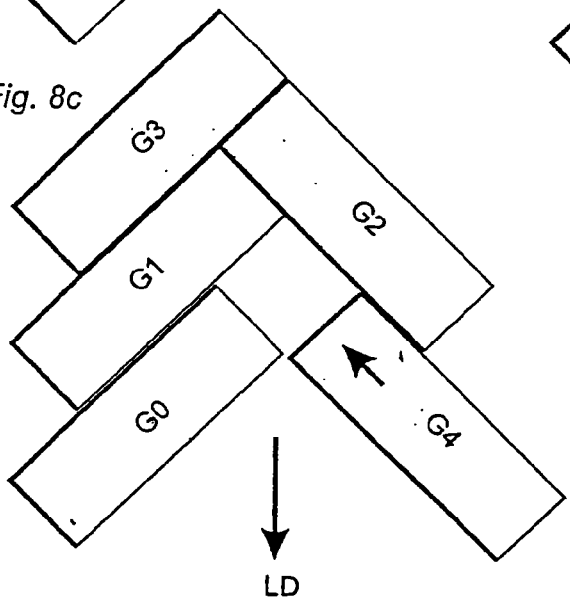

FIG. 8*c* shows how a further floorboard G4 is added. First one long side of the floorboard G4 is connected with the long side of the floorboard G2. Subsequently the floorboard G4 is moved in between the floorboards G2 and G0 so that connection of the other long side of the floorboard G4 and the short side of the floorboard G0 takes place by a displacing motion, in which the connecting means of the floorboard G4 are linearly displaced into the connecting means on the short side of the floorboard G0, for the connecting means on the short side of the floorboard G4 to be connected with the long side of the floorboard G1 by snapping-in.

The adding of further floorboards takes place by repeating the steps according to FIG. 8*c*.

FIGS. 8*d* and 8*e* show an alternative way of adding floorboards to an installed row of boards G0, G1, G3.

In FIG. 8*d*, the floorboard G2 can be connected with the floorboard G0 and G1 either by the long side of the floorboard G2 being first connected with the short side of the floorboard G0 by inward angling, insertion or snapping-in and then being displaced in the connected state until its short side is connected with the long side of the floorboard G1 by snapping-in, or by the short side of the floorboard G2 first being connected with the long side of the floorboard G1 by inward angling, insertion or snapping-in and then being displaced in the connected state along the same until its short side is connected with the long side of the floorboard G1 by snapping-in.

FIG. 8*e* shows the adding of a further floorboard G4. It is preferred for the long side of this floorboard first to be connected by inward angling, snapping-in or insertion with the floorboards G1 and G4, whose long side and short side respectively are aligned with each other and form a uniform continuous joint edge. Then the floorboard G4 is displaced along this joint edge until the short side of the floorboard G4 is joined with the long side of the floorboard G3 by snapping-in. Alternatively, the reverse joining sequence may be used, i.e. first the short side of the floorboard G4 is joined with the long side of the floorboard G3 by inward angling, insertion or snapping-in, and then the floorboard G4 is displaced in the connected state along the long side of the floorboard G3 until the long side of the floorboard G4 is connected with the short sides and long sides respectively of the floorboards G1 and G2.

The installation methods described above can be combined if required by the current installation situation. As a rule, when two joint edges are interconnected or locked together, that part of the joint edge which is active in the interconnection or locking-together of the joint edges may constitute a larger or smaller part of the joint edge. Interconnection or locking-together of two floorboards can thus take place even if only a small part of the joint edge of the respective floorboard is active.

FIGS. 9*a-e* show different ways of terminating the floor along the walls. A simple method is just to cut the ends of the floorboards so that they obtain a shape that connects to the walls. After cutting, the cut-off edge may be covered with a baseboard in prior-art manner.

A second alternative may be to use a frame comprising one or more rows of floorboards which are laid along the walls and which may have a shape according to the numbered floorboards 1-13. With such laying, all floorboards in the frame except the floorboard A13 can be joined mechanically. The other floorboards can be cut off in conjunction with installation and be connected in a suitable manner using glue, or by making a tongue groove or tongue by means of, for instance, a hand-milling machine. Alternatively, a tongue groove and a loose tongue can be used as shown in FIGS. 9*c* and 9*d*.

Figure 9A:
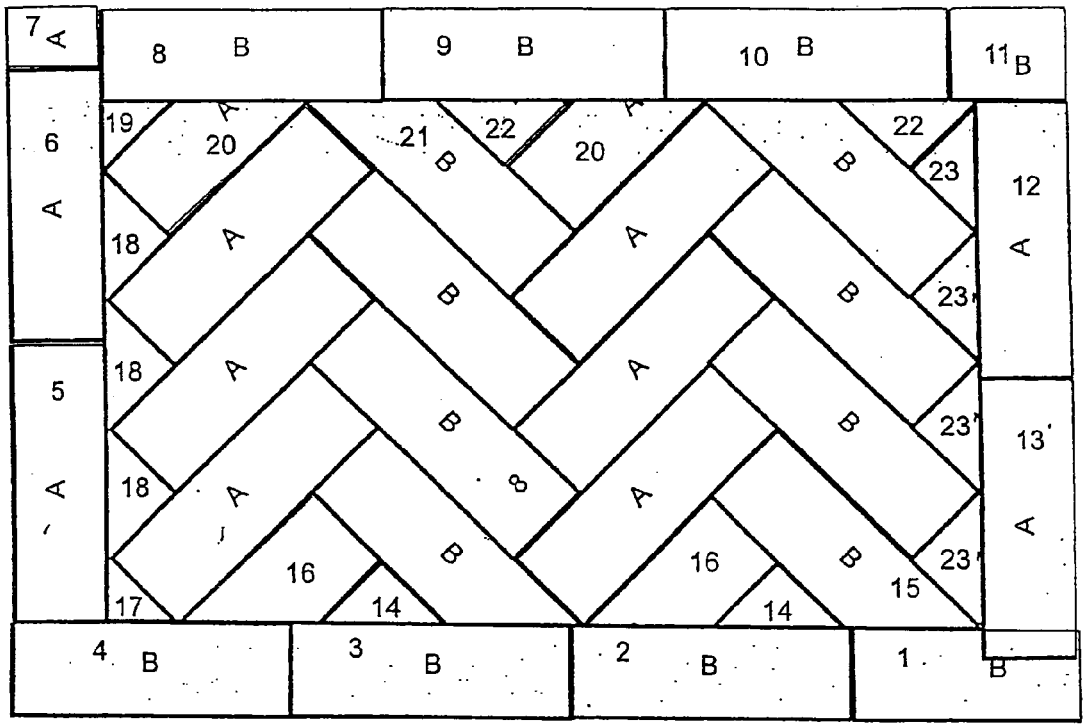
FIGS. 9*a-e* show fitting pieces for producing a herring-bone pattern flooring according to the invention.
Figure 9B:
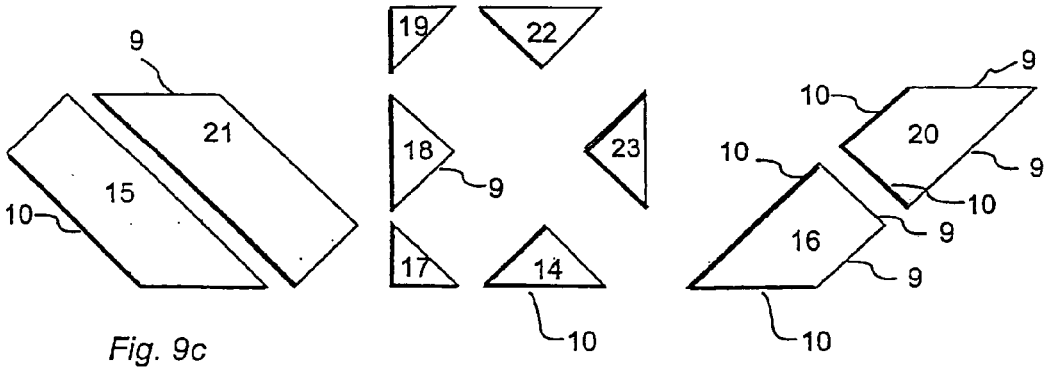

A third alternative is that the frame 1-13 is filled with 10 different factory-made fitting pieces 1423, which are shown in FIG. 9*b* and which have a mechanical joint system with a groove side 9 (indicated with a thin line) and a tongue side 10 (indicated with a thick line). The fitting pieces can be of different shapes, such as triangles or trapezoids, and preferably have an oblique side, which is cut to a suitable angle to fit the other floorboards. In a normal herringbone parquet floor this angle is preferably 45(. Also other patterns and angles than those shown in FIG. 9 are feasible. According to one embodiment, the fitting pieces are provided with connecting means on all edge portions for cooperation with adjoining floorboards, as shown in FIG. 9*b*. It is also possible to make the fitting pieces by cutting the floorboards to a suitable shape and then providing them with connecting means, either on the site of installation by using a mobile set of tools, or by the fitting pieces after cutting being transferred to a factory or workshop for machining.

What is here said about designing of the connecting means on the floorboards is applicable in appropriate parts also to the fitting pieces.

Figure 9C:
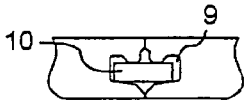
Figure 9D:
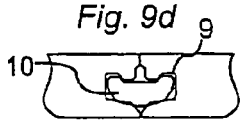
Figure 9E:
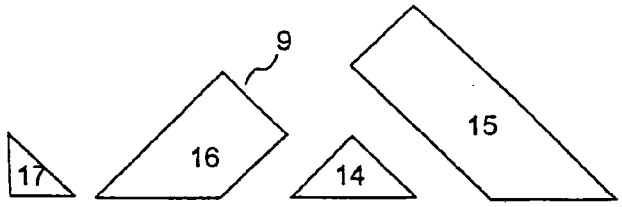

If the fitting pieces are only provided with a groove 9 and if a loose tongue 10 is used as shown in FIG. 9*c* for joining by means of glue or with a loose tongue 10 which also constitutes a mechanical joint system according to FIG. 9*d*, the number of fitting pieces in the assortment can be reduced significantly since these fitting pieces can then be mirror-inverted. In the preferred alternative, the number of fitting pieces can be reduced to four different fitting pieces marked in FIGS. 9 with 14, 15, 16 and 17. A factory-made groove with a loose tongue may facilitate installation significantly since the vertical position of the groove in relation to the surface of the floorboards can be obtained with greater accuracy than is allowed when using, for instance, hand tools. The loose tongue 10 may consist of, for instance, an extruded section of plastic or aluminum. It can also be made by machining a suitable wood fiber based board, wood material or the like.

Figure 1B:
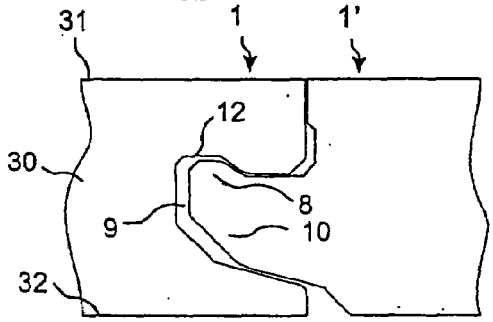
Figure 1C:
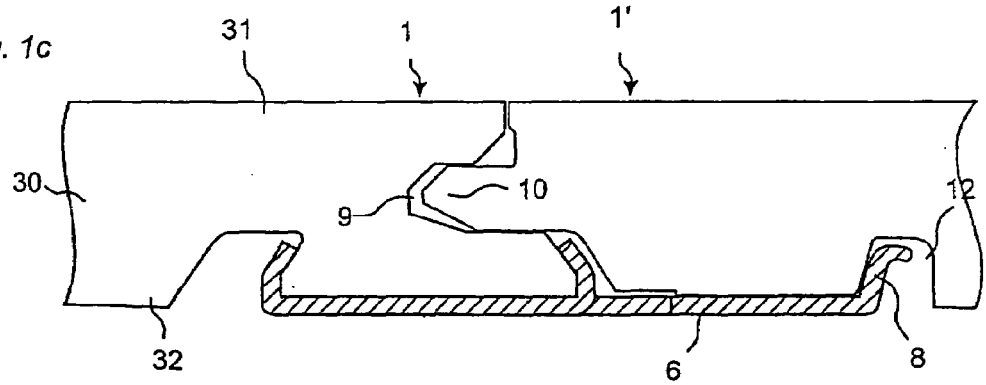
Figure 1D:
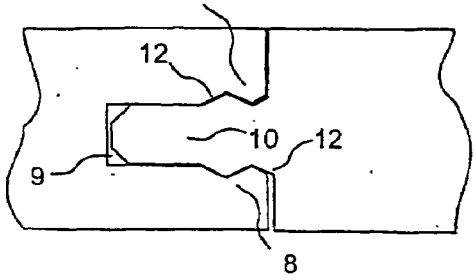
Figure 1E:
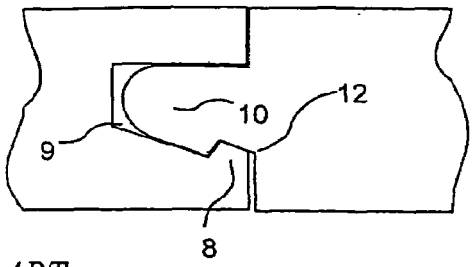

The loose tongue 10 shown in FIG. 9*d* constitutes both a vertical and a horizontal locking means and thus enables mechanical joining of all sides of a board with other similar floorboards. The loose tongue 10 can be shaped in many different ways with one or more horizontal connecting means on both sides, and it can be designed for joining by snapping-in, insertion and/or inward angling. Variants of the tongue types 10 as shown in FIGS. 1*b*, 1*d* and 1*e* as well as other known locking systems can be modified so that they may constitute two-sided loose tongue elements with locking elements 8 which lock floorboards whose joint edges are formed with suitable cooperating tongue grooves 9 with locking grooves 12 analogously to FIG. 9*d*.

Further a strip can be provided, which can be mounted on a cut-off edge of a floorboard and which is intended for cooperation, such as interconnection or locking-together, with locking means of adjoining floorboards. The strip can be made of a suitable material, such as wood, aluminum, plastic etc, and can be adapted to be fastened to a floorboard edge which, as a result of e.g. cutting off, does not have an integrated mechanical locking system. The strip is conveniently adjusted to the type of connecting means with which the other floorboards are provided, and it can be mounted with or without preceding milling. The strip can be provided by the meter to be cut off as required. Suitably the strip is fastened to the floorboard in a mechanical manner, such as by engagement in some kind of strip, recess or hole in the floorboard, but also glue, screws, nails, clips, adhesive tape or other fastening means are conceivable.

It is also possible to combine the embodiments so that both fitting pieces with factory-made connecting means on all edge portions and fitting pieces with other arrangements of connecting means are used in the same floor. For instance, the factory-made pieces can in such a case contribute to simplifying the fitting between the floorboards which constitute the frame and the floorboards which constitute the actual herringbone pattern. By means of this system, the frame can thus be laid along one or two walls, after which the herringbone pattern is connected to the frame by means of the fitting pieces, and the floor is laid starting from a first corner in the room. Adjustment for connection to the other walls can then take place using other types of connecting means or even in a conventional way, completely without connecting means.

Figure 10A:
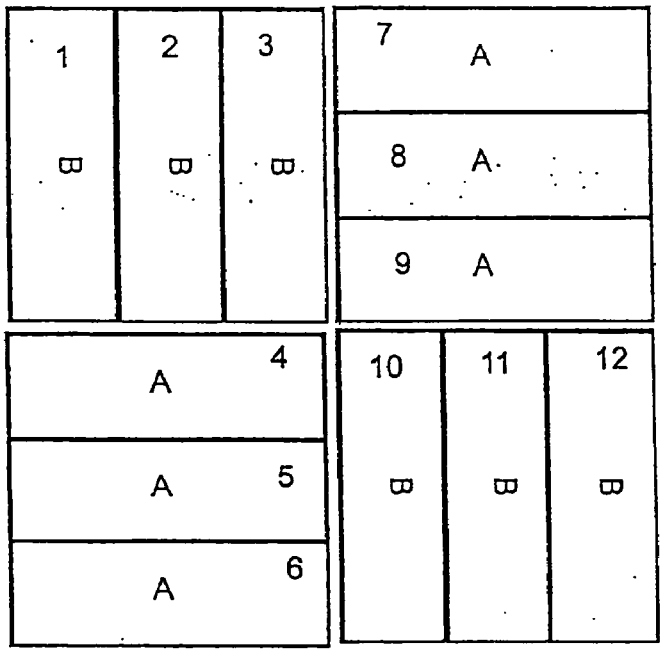
FIGS. 10*a-c* show different laying patterns according to the invention.
Figure 10B:
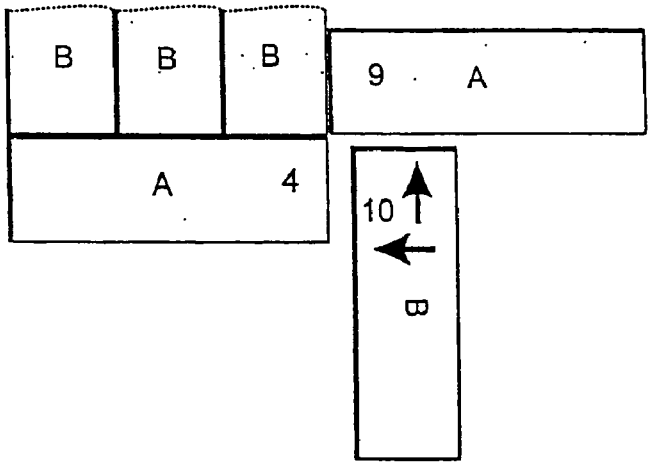
Figure 10C:
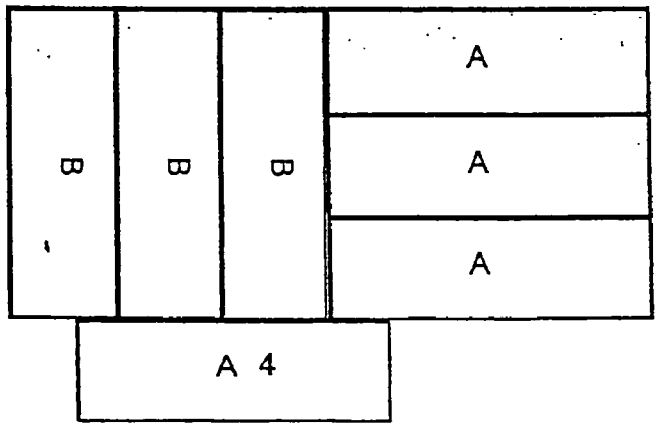

FIGS. 10*a-c* show laying in a diamond pattern. Also in this embodiment, displacement in the locked position and snapping-in can be used for rational laying.

FIG. 10*a* shows a pattern in which floorboards of two types A, B can be laid. The numbering in FIG. 10*a* represents a possible laying sequence.

FIG. 10*b* shows how floorboards of the two types A, B are joined short side against long side to form the pattern according to FIG. 10*a*.

FIG. 10*c* shows a method for facilitating laying of symmetrical patterns. The board A4 is laid offset to facilitate laying of the other A boards aligned with the short sides of the B boards. Then the board A4 may be pushed back to the correct position before continued laying, but it may also be centered between the A and B boards, and the diamonds can thus be laid in offset rows. The diamond pattern according to FIG. 10 can advantageously be combined with wood blocks of other sizes to form, for instance, a so-called Dutch pattern.

Figure 11:
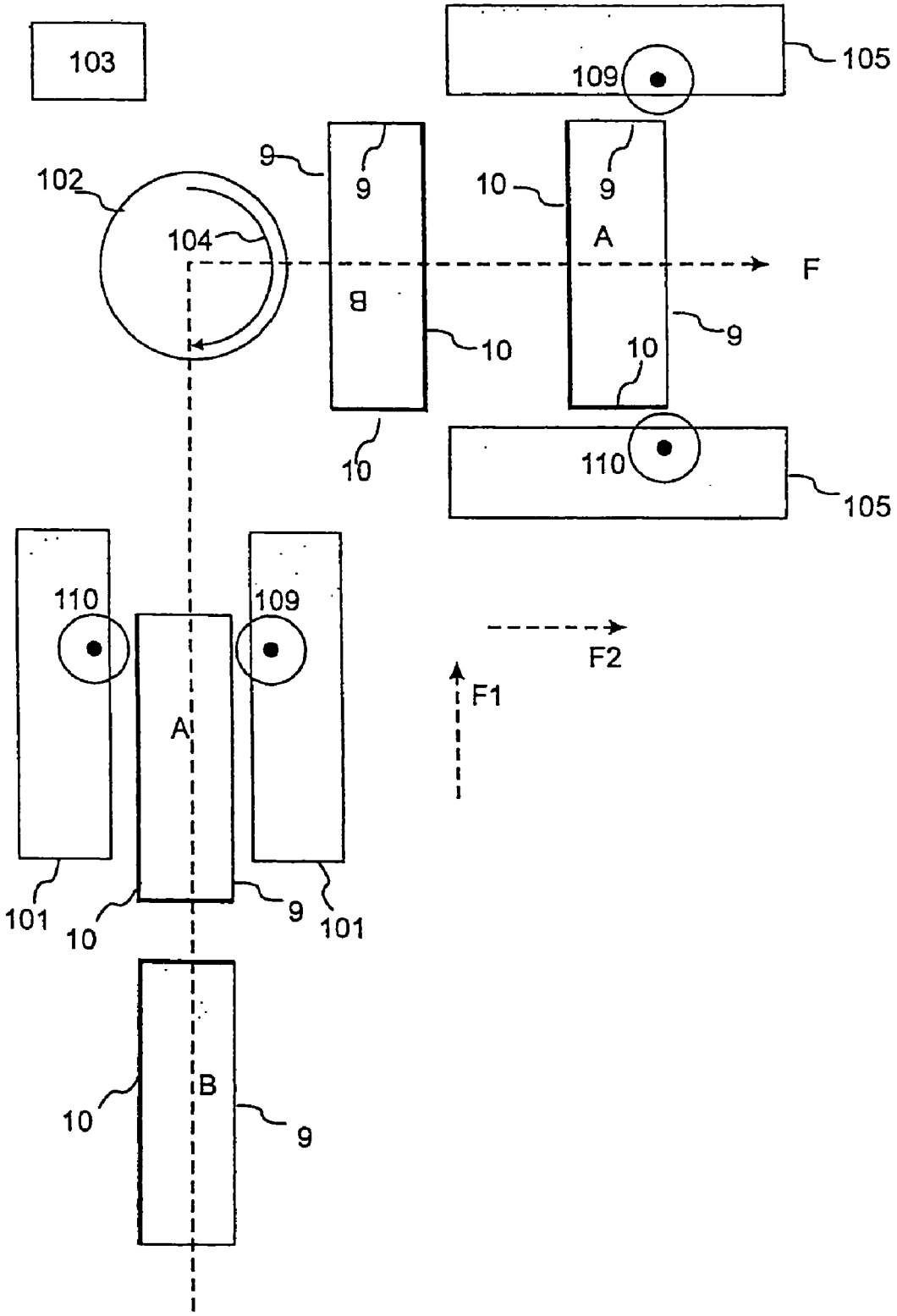
FIG. 11 illustrates schematically a production method for producing floorboards according to the invention.

FIG. 11 shows schematically a method for producing floorboards according to the present invention. Rational production of floorboards is essentially carried out in such manner that a set of tools and a floorboard blank are displaced relative to each other. The set of tools can advantageously be adapted to machine two opposite edge portions in one and the same displacing motion. This can be achieved by sets of tools 109 and 110 for making the respective locking means being arranged on each side of the path of movement F of the floorboard. A set of tools consists preferably of one or more milling tools which are dimensioned for quick machining of a profile in a manner known to those skilled in the art. In the example according to FIG. 11, use is a made of one set of tools 109 for machining the side where the groove 9 of the vertical locking means is formed and another set of tools 110 for machining the side where the tongue 10 of the vertical locking means is formed.

After a first machining step 109 which produces the locking means on one pair of opposite edges of the floorboard, a second machining step 105 is carried out, which produces the locking means on the other pair of opposite edges of the floorboard. This second machining step 105 takes place, just as the first, by displacement of the set of tools and the floorboard blank relative to each other but in a second direction which preferably is perpendicular to the first direction. The machining steps 101, 105 take place in a manner known to those skilled in the art and the order between them may be varied within the scope of the present invention.

As a rule, production of large amounts of floorboards is fully automated. The floorboard is thus moved automatically between the two production steps, which can be arranged so that the floorboard blank is first moved in a first direction F1 in the longitudinal direction of the floorboard through a first machining device which comprises the first set of tools 109*a*, 110*a* and then in a direction F2 which is essentially perpendicular to the first direction through a second machining device which comprises the second set of tools 109*b*, 110*b*. The floorboards that are produced according to this method will all be of the same type, i.e. A or B according to the invention.

According to the invention, however, an existing production plant for production of floorboards of one type according to the invention can be adjusted for production of both types of floorboards using the same sets of tools. This takes place by a first type of floorboard (for instance A) being produced as described above, i.e. in two machining steps, while floorboard blanks which are to constitute a second type of floorboard (for instance B), after the first machining step 101 in step 104 is rotated half a turn in its plane. Subsequently the floorboard blank continues to the second machining step 105. As a result, the position of one pair of connecting means on the floorboard B will be reversed, compared with the floorboard A. The floorboard B will thus be mirror-inverted in relation to the floorboard A.

Control of which boards are to be rotated can take place based on information from a control system 103 which controls a rotating device 102 which rotates the floorboard blank after the first machining step 101 before it is transferred to the second production step 105.

When the floorboards A and B according to this preferred method are produced in the same line and with the same setting of tools, the two floorboards will have exactly the same length and width. This significantly facilitates symmetrical laying of patterns.

It is an advantage if the floorboards after installation can be taken up again and be relaid without the joint system being damaged. The take-up of a floorboard is conveniently made by a method which is essentially reversed compared with the installation method. One side, in most cases the short side, is released by the floorboard being pulled out horizontally so that the locking element 8 leaves the locking groove 12 by snapping-out. The other side, most conveniently the long side, can then be released by being pulled out along the joint edge, by upward angling or by snapping-out.

Figure 12A:
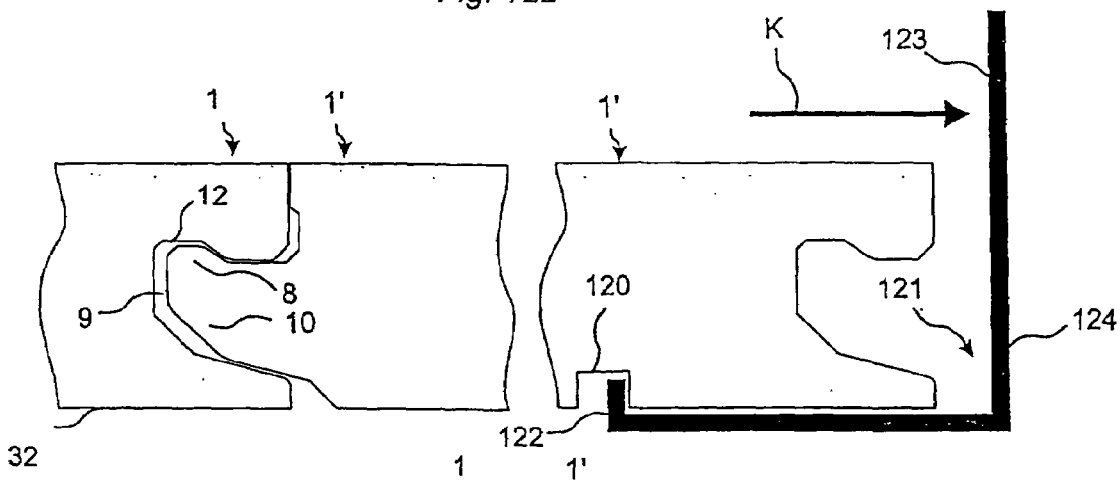
FIGS. 12*a—d* illustrate various alternative embodiments.
Figure 12B:
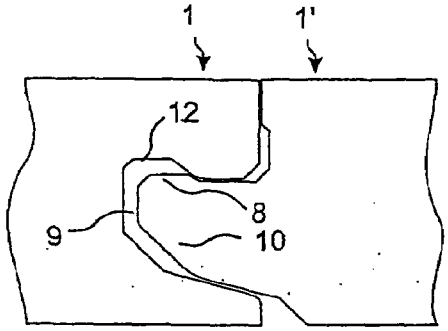
Figure 12C:
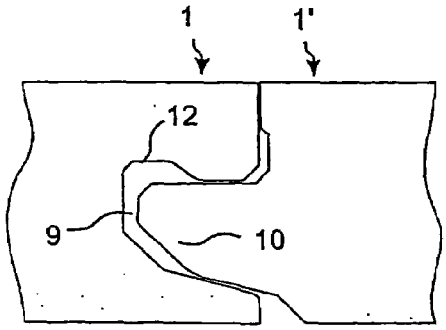
Figure 12D:
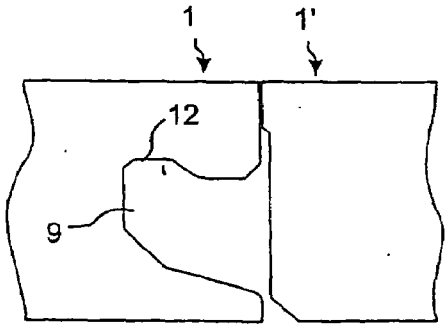

FIGS. 12*a-d* show various alternatives of releasing floorboards. In FIG. 12*a*, the floorboard 1 has on the rear side 32 of the short side a gripping groove 120 which is adapted to a gripping tool 121 so that this gripping tool can engage in the gripping groove 121 with its gripping means 122. This gripping means is connected with a means 123 which allows pressure or impact essentially in the horizontal direction K to be applied to the tool means outside the underside 32 of the floorboard and in this way release the board without it being damaged. The force can be applied by, for instance, impact (using e.g. a hammer or club, pulling or jerking at a handle or the like). The gripping tool can alternatively be designed so that its gripping means engages in another part of the floorboard, for instance the locking groove 12 or the locking element 8, depending on the design of the joint system on the short side. Snapping-out can be facilitated by the locking element, for instance on the short side, being adjusted, for example by being made lower or with other radii etc. than on the long side, so that snapping-out and thus disconnection can take place at a lower tensile stress than, for example, for the long side. The joint system of the long side can consequently be designed, for instance, according to FIG. 12*a* and the short side according to FIG. 12*b* where the joint system has the same geometry except that the locking element 8 is lower. If the floorboards are laid at an angle with long side against short side according to FIG. 5*b*, the long sides will prevent the short sides from separating. In such a laying pattern, short sides can be formed merely with vertical locking means according to FIG. 12*c*, or completely without locking means as in FIG. 12*d*. The gripping tool can be used to release also other types of mechanically joined floorboards which are laid in other patterns, such as parallel rows. It will be appreciated that a plurality of different combinations of embodiments of connecting means and installation methods are feasible to provide an optimal flooring as regards both installation method, durability and disassembly for reuse.

The inventor has tested many different patterns which are all obvious, provided that floorboards of the same or different formats and with snappable and mirror-inverted joint systems are used in installation of flooring. Basically, the invention can be used to provide all the patterns that are known in connection with installation of parquet flooring with tongue and groove, but also parquet flooring which is laid by gluing or nailing to the base and which thus does not have a joint system which restricts the possibilities of joining optional sides. It is also possible to produce floorboards which have more than four sides and which can have a first pair of connecting means on 3, 4 or more sides and a second pair of connecting means on corresponding adjoining sides. Floorboards can also be made with more than two different pairs of cooperating locking means. It is possible to use all prior-art mechanical joint systems which can be snapped together.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A method for making a floor of mechanically locked floorboards, each of said two different types of floorboards along their four edge portions having pairs of opposing connectors for locking adjoining first type and second type floorboards in both a vertical and a horizontal direction, the connectors of the first type and second type floorboards designed to allow locking-together in a first direction in a plane of the floorboards by at least snapping-in and locking-together in a second direction in the plane of the floorboards by inward angling and/or snapping-in, and the first type floorboard differing from the second type floorboard because the connector of the first type floorboard along one pair of opposite edge portions is arranged in a mirror-inverted manner relative to a corresponding connector along the same pair of opposite edge portions of the second type floorboard, the method comprising:

(a) locking together a short side of a first floorboard with a long side of a second floorboard, the first floorboard being of the first type floorboard and the second floorboard of the second type floorboard;

(b) locking together a first edge portion of a third floorboard with a long side of one of the previously connected first floorboard and second floorboard and displacing said first edge portion of the third floorboard along the same to locking-together by snapping in a second edge portion of the third floorboard with a long side of the other of the previously connected floorboards; and (c) repeating step (b) to add further floorboards.

2. The method as claimed in claim 1, wherein the locking-together of the first floorboard and the second floorboard is by inward angling.

3. The method as claimed in claim 1, wherein the locking-together of the first floorboard and the second floorboard is by snapping-in.

4. The method as claimed in claim 1, wherein the locking-together of the first floorboard and the second floorboard is by insertion along an edge portion of the one first floorboard or second floorboard.

5. The method as claimed in claim 1, wherein the locking-together of the first edge portion of the third floorboard with one of the first floorboard and the second floorboard is by inward angling.

6. The method as claimed in claim 1, wherein the locking-together of the first edge portion of the third floorboard with one of the first floorboard and the second floorboard is by snapping-in.

7. The method as claimed in claim 1, wherein the locking-together of the first edge portion of the third floorboard with one of the first floorboard and the second floorboard is by insertion along an edge portion of the one first floorboard or second floorboard.

* * * * *